US009318119B2

(12) United States Patent
Sugiyama et al.

(10) Patent No.: US 9,318,119 B2
(45) **Date of Patent: *Apr. 19, 2016**

(54) NOISE SUPPRESSION USING INTEGRATED FREQUENCY-DOMAIN SIGNALS

(75) Inventors: Akihiko Sugiyama, Tokyo (JP); Masanori Kato, Tokyo (JP)

(73) Assignee: NEC CORPORATION, Tokyo (JP)

( * ) Notice: Subject to any disclaimer, the term of this patent is extended or adjusted under 35 U.S.C. 154(b) by 914 days.

This patent is subject to a terminal disclaimer.

(21) Appl. No.: 11/794,563

(22) PCT Filed: Aug. 29, 2006

(86) PCT No.: PCT/JP2006/016963

§ 371 (c)(1),
(2), (4) Date: Jun. 29, 2007

(87) PCT Pub. No.: WO2007/026691

PCT Pub. Date: Mar. 8, 2007

(65) Prior Publication Data

US 2010/0010808 A1 Jan. 14, 2010

(30) Foreign Application Priority Data

Sep. 2, 2005 (JP) ..... 2005-255748

(51) Int. Cl.
*G10L 21/0208* (2013.01)
*G10L 19/02* (2013.01)
*G10L 21/0216* (2013.01)

(52) U.S. Cl.
CPC ..... *G10L 21/0208* (2013.01); *G10L 19/0204* (2013.01); *G10L 21/0216* (2013.01)

(58) Field of Classification Search
USPC ..... 704/226–228
See application file for complete search history.

(56) References Cited

U.S. PATENT DOCUMENTS 4,628,529 A * 12/1986 Borth et al. ..... 381/94.3
5,012,519 A * 4/1991 Adlersberg et al. ..... 704/226

(Continued)

FOREIGN PATENT DOCUMENTS

JP 63-500543 2/1988
JP 08-130478 5/1996

(Continued)

OTHER PUBLICATIONS

Jung et al., "Feature Extraction through the post processing of WFBA based on MMSE-STSA for Robust Speech Recognition", 2004 Journal of the Acoustical Society of Korea, Nov. 2004, pp. 39-42, Vo. 23, No. 2.

(Continued)

*Primary Examiner* — Douglas Godbold
(74) *Attorney, Agent, or Firm* — Scully, Scott, Murphy & Presser, P.C.

(57) ABSTRACT

To provide a noise suppressing method and apparatus capable of achieving high-quality noise suppression using a lower amount of operations. Noise contained in an input signal is suppressed by transforming the input signal into frequency-domain signals; integrating bands of the frequency-domain signals to determine integrated frequency-domain signals; determining estimated noise based on the integrated frequency-domain signals; determining spectral gains based on the estimated noise and said integrated frequency-domain signals; and weighting said frequency-domain signals by the spectral gains.

25 Claims, 23 Drawing Sheets

(56) References Cited

U.S. PATENT DOCUMENTS

| | | | | |
|---|---|---|---|---|
| 5,432,859 | A * | 7/1995 | Yang et al. | 381/94.3 |
| 5,544,250 | A * | 8/1996 | Urbanski | 381/94.3 |
| 5,659,622 | A | 8/1997 | Ashley | |
| 5,812,970 | A * | 9/1998 | Chan et al. | 704/226 |
| 6,144,937 | A | 11/2000 | Ali | |
| 6,381,570 | B2 * | 4/2002 | Li et al. | 704/233 |
| 6,415,253 | B1 * | 7/2002 | Johnson | 704/210 |
| 6,477,489 | B1 * | 11/2002 | Lockwood et al. | 704/200.1 |
| 6,529,868 | B1 * | 3/2003 | Chandran et al. | 704/226 |
| 6,691,090 | B1 * | 2/2004 | Laurila et al. | 704/250 |
| 6,757,395 | B1 * | 6/2004 | Fang et al. | 381/94.3 |
| 6,766,292 | B1 * | 7/2004 | Chandran et al. | 704/224 |
| 7,058,572 | B1 * | 6/2006 | Nemer | 704/226 |
| 7,096,182 | B2 * | 8/2006 | Chandran et al. | 704/226 |
| 2002/0062211 | A1 * | 5/2002 | Li et al. | 704/236 |
| 2002/0152066 | A1 * | 10/2002 | Piket | 704/226 |
| 2002/0156624 | A1 * | 10/2002 | Gigi | 704/226 |
| 2003/0065509 | A1 * | 4/2003 | Walker | 704/228 |
| 2003/0128851 | A1 * | 7/2003 | Furuta | 381/94.2 |
| 2003/0135364 | A1 * | 7/2003 | Chandran et al. | 704/226 |
| 2004/0049383 | A1 * | 3/2004 | Kato et al. | 704/226 |
| 2004/0148160 | A1 * | 7/2004 | Ramabadran | 704/221 |
| 2005/0240401 | A1 * | 10/2005 | Ebenezer | 704/226 |
| 2006/0025993 | A1 * | 2/2006 | Aarts et al. | 704/228 |
| 2010/0174535 | A1 * | 7/2010 | Vos et al. | 704/207 |

FOREIGN PATENT DOCUMENTS

| | | | |
|---|---|---|---|
| JP | 9-44186 | | 2/1997 |
| JP | 9-251299 | | 9/1997 |
| JP | 11-289312 | | 10/1999 |
| JP | 2000-357969 | | 12/2000 |
| JP | 2002-204175 | | 7/2002 |
| JP | 2003-131689 | | 5/2003 |
| JP | 2004-289762 | | 10/2004 |
| JP | 2005-195955 | | 7/2005 |
| JP | 2005-202222 | | 7/2005 |
| JP | 4172530 | B2 | 10/2008 |
| WO | WO/87/00366 | | 1/1987 |
| WO | 02/080148 | A1 | 10/2002 |
| WO | WO 02/090148 | A1 | 10/2002 |
| WO | 2007/026691 | A1 | 3/2007 |
| WO | 1921609 | A1 | 5/2008 |

OTHER PUBLICATIONS

Sugiyama, Akihiko, et al.; A Low-Complexity Noise Suppressor with Nonuniform Subbands and a FrequencyDomain Highpass Filter, 2005 IEICE Engineering Sciences Society Taikai Koen Ronbunshu, A-4-5, p. 74, Sep. 7, 2005.

E. Zwicker et al., "Psychoacoustics", Facts and Model, Second Updated Edition, Springer, Jan. 1999, pp. 158-164.

Masanori Kato et al., A Low-Complexity Noise Suppressor with Nonuniform Subbands and a Frequency-Domain Highpass Filter, Proc. of ICASSP 2006, pp. 1-473 to 1-476, May 2006.

Japanese Office Action dated Apr. 13, 2011 corresponding to related Japanese case.

Kato, M. et al., "A Family of 3GPP-Standard Noise Suppressors for the AMR Codec and the Evaluation Results", ICASSP, IEE International Conference on Acoustics, Speech and Signal Processing—Proceedings, IEEE, vol. 1, pp. 916-919, XP002677698, Apr. 6, 2003.

Sugiyama A., et al. "Test Results of NEC Low Complexity AMR-NS Solution based on TS 26.077" 3GPP, pp. 1-2 paragraph 2, figure 2, TSG-SA#22 Meeting, Tampere, Finland Jul. 22-26, 2002 (retrieved Sep. 16, 2002).

Supplementary European Search Report dated Jun. 27, 2012 received form the European Patent Office in counterpart case, namely EP 06 79 6943.

* cited by examiner

PRIOR ART

NOISE SUPPRESSION USING INTEGRATED FREQUENCY-DOMAIN SIGNALS

TECHNICAL FIELD

The present invention relates to a method and apparatus for suppressing noise to reduce the noise superimposed on a desired audio signal as well as to a computer program for use in signal processing of noise suppression.

BACKGROUND ART

A noise suppressor (noise suppressing system) is a system for suppressing noise superimposed on a desired audio signal, and typically estimates the power spectrum of the noise component using the input signal that was converted into frequency domain, and subtracts this estimated power spectrum from the input signal to thereby suppress the noise mixed in the desired audio signal. When the power spectrum of the noise component is continuously estimated, it is possible to deal with the suppression of irregular noise. A conventional noise suppressor is disclosed in patent document 1 (Japanese Patent Application Laid-open 204175/2002), for example.

Usually, a digital signal that has been obtained by analog-to-digital (AD) conversion of an output signal from a microphone that corrects speech waves is supplied as an input signal to a noise suppressor. Mostly, in general a high-pass filter is disposed between AD conversion and a noise suppressor in order to suppress a low-frequency component that is added during speech collection with a microphone or during AD conversion. An example of such a configuration is disclosed in patent document 2 (U.S. Pat. No. 5,659,622).

FIG. 1 shows a configuration in which a high-pass filter of patent document 2 is applied to a noise suppressor of patent document 1.

Supplied to input terminal 11 is a noisy speech signal (a signal that contains a desired speech signal and noise) as a sequence of sample values. The noisy speech signal samples are supplied to high-pass filter 17 where the low-pass component is suppressed, and then are supplied to frame divider 1. Suppression of the low-pass component is an essential process in order to maintain the linearity of the input noisy speech and to present high enough signal processing performance. Frame divider 1 divides the noisy speech signal samples into frames of a specified number of samples and transmits them to windowing processor 2. Windowing processor 2 multiplies the divided frame of noisy speech samples by a window function and transmits the result to Fourier transformer 3.

Fourier transformer 3 performs a Fourier transform on the windowed, noisy speech samples to divide the samples into a plurality of frequency components and multiplex the amplitude values and supplies them to estimated noise calculator 52, spectral gain generator 82 and multiplex multiplier 16. The phases are transmitted to invert Fourier transformer 9. Estimated noise calculator 52 estimates the noise for each of the supplied multiple frequency components and transmits them to spectral gain generator 82. As an example of noise estimation, there is a method of estimating the noise component by weighting the noisy speech based on the past signal-to-noise ratio, the detail being described in patent document 1.

Spectral gain generator 82 generates individual spectral gains for multiple frequency components, in order to produce enhanced speech with noise suppressed by multiplying the noisy speech by the coefficients. As one example of generating spectral gains, the least mean square short period spectrum amplitude method in which the mean square power of enhanced speech is minimized has been widely used. Details are described in patent document 1.

The spectral gains generated for individual frequencies are supplied to multiplex multiplier 16. Multiplex multiplier 16 multiplies the noisy speech supplied from Fourier transformer 3 and the spectral gain supplied from spectral gain generator 82 for every frequency, and transmits the products as the amplitudes of the enhanced speech to inverse Fourier transformer 9. Inverse Fourier transformer 9 performs inverse Fourier transformation making use of the enhanced speech amplitudes supplied from multiplex multiplier 16 and the phases of the noisy speech supplied from Fourier transformer 3 and supplies the result as enhanced speech signal samples to frame synthesizer 10. This frame synthesizer 10 synthesizes output speech samples of the current frame using the enhanced speech samples of the neighboring frame and outputs the result to output terminal 12.

DISCLOSURE OF INVENTION

High-pass filter 17 suppresses the frequency components in the vicinity of the direct current, and usually permits components having frequencies equal to or greater than 100 Hz to 120 Hz to pass through as they are without suppression. Though high-pass filter 17 can be configured of either a finite impulse response (FIR) type filter or an infinite impulse response (IIR) type filter, usually the latter is used because a sharp passband end characteristic is needed. It is known that the transfer function of an IIR type filter is represented by a rational function and the sensitivity of the denominator coefficient is markedly high. Accordingly, when high-pass filter 17 is realized by finite word length operations, it is necessary to use frequent double precision operations in order to achieve high enough precision. So there has been the problem that the amount of operations becomes great. In contrast, if high-pass filter 17 is omitted in order to reduce the amount of operations, it is difficult to maintain the linearity of the input signal, hence it is impossible to achieve high-quality noise suppression.

Also, in estimated noise calculator 52, noise is estimated for all the frequency components supplied from Fourier transformer 3, and in spectral gain generator 82, spectral gains corresponding to these are determined. Therefore, if the block length (frame length) for the Fourier transform is made longer in order to improve frequency resolution, the number of samples constituting each block becomes greater, resulting in the problem that the amount of operations increases.

The object of the present invention is to provide a noise suppressing method and apparatus capable of achieving high-quality noise suppression using a lower amount of operations.

A noise suppressing method according to the present invention includes the steps of: transforming an input signal into frequency-domain signals; integrating bands of the frequency-domain signals to determine integrated frequency-domain signals; determining estimated noise based on the integrated frequency-domain signals; determining spectral gains based on the estimated noise and the aforesaid integrated frequency-domain signals; and weighting the aforesaid frequency-domain signals by the spectral gains.

Also, a noise suppressing apparatus according to the present invention includes: a transformer for transforming an input signal into frequency-domain signals; a band integrator for integrating bands of the frequency-domain signals to determine integrated frequency-domain signals; a noise estimator for determining estimated noise based on the integrated frequency-domain signals; a spectral gain generator for determining spectral gains based on the estimated noise and the aforesaid integrated frequency-domain signals; and a multiplier for weighting the aforesaid frequency-domain signals by the spectral gains.

Further, a computer program that performs signal processing for suppressing noise causes a computer to execute: a process of transforming the input signal into frequency-domain signals; a process of integrating bands of the frequency-domain signals to determine integrated frequency-domain signals; a process of determining estimated noise based on the integrated frequency-domain signals; a process of determining spectral gains based on the estimated noise and the aforesaid integrated frequency-domain signals; and a process of weighting aforesaid frequency-domain signals by the spectral gains.

In particular, the method, apparatus and computer program for suppressing noise of the present invention are characterized by execution of suppression of low-pass components for the signal after the Fourier transform. More specifically, the invention is characterized by inclusion of an amplitude modifier for suppressing low-pass components for the amplitudes of the Fourier transformed output and a phase modifier for performing phase correction corresponding to amplitude deformation of low-pass components for the phase of the Fourier transformed output.

Also, the invention is characterized in that noise estimation and generation of spectral gains are performed for multiple frequency components. More specifically, the invention is characterized by inclusion of a band integrator for integrating part of multiple frequency components.

According to the present invention, it is possible to achieve high quality noise suppression with a lower amount of operations, by means of single-precision operations because the amplitude of the signal that was converted into frequency domain is multiplied by a constant and a constant is added to the phase. Further, according to the present invention, noise estimation and generation of noise coefficients are performed for a lower number of frequency components than the number of samples that constitute each block of Fourier transform, so that it is possible to reduce the amount of operations.

DESCRIPTION OF REFERENCE NUMERALS

Figure 1:
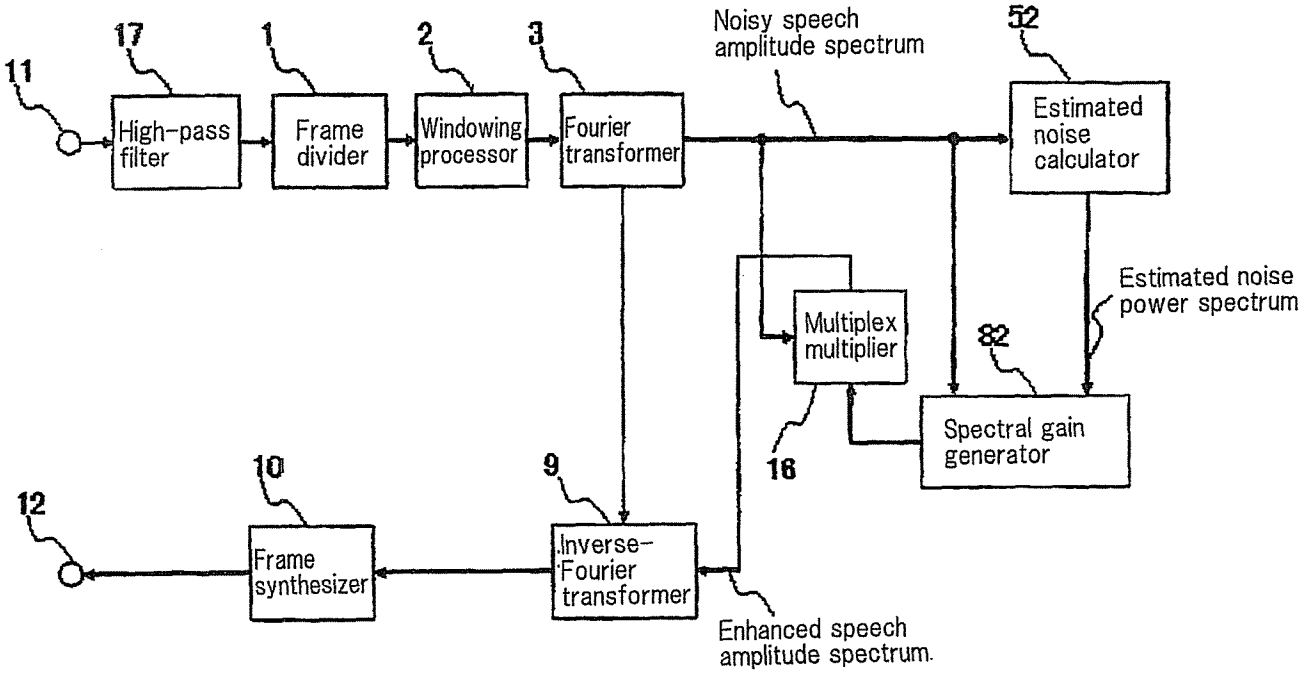
FIG. 1 is a block diagram showing a configurational example of a conventional noise suppressing apparatus.

1 frame divider
2,20 windowing processor
3 Fourier transformer
4,5049 counter
5,52 estimated noise calculator
6,1402 frequency-classified SNR calculator
7, estimated apriori SNR calculator
8,82 spectral gain generator
9 inverse Fourier transformer
10 frame synthesizer
11 input terminal
12 output terminal
13,16,161,704,705,1404 multiplexed multiplier
14 weighted noisy speech calculator
15 spectral gain modifier
17 high-pass filter
18 amplitude modifier
19 phase modifier
21 speech non-existence probability memory
22 offset remover
53 band integrator
54 estimated noise modifier
501,502,1302,1303,1422,1423,1495,1502,1503,1602,1603,1801,1901,7013,7072,7074 demultiplexer
503,1304,1424,1475,1504,1604,1803,1903,7014,7075 multiplexer
$\mathbf{504}_0$ to $\mathbf{504}_{M-1}$ frequency-classified estimated noise calculator
520 update controller

701 multiplexed limiter
702 aposteriori SNR memory
703 spectral gain memory
706 weight memory
707 multiplexed weighting accumulator
708,5046,7092,7094 adder
811 MMSE STSA gain function value calculator
812 generalized likelihood ratio calculator
814 spectral gain calculator
921 temporary estimated SNR
921$_0$ to 921$_{M-1}$ frequency-band-classified temporary estimated SNR
922 past estimated SNR
922$_0$ to 922$_{M-1}$ past frequency-band-classified estimated SNR
923 weight
924 estimated apriori SNR
924$_0$ to 924$_{M-1}$ frequency-band-classified estimated apriori SNR
1301$_0$ to 1301$_{K-1}$,1597,7091,7093 multiplier
1401,5042 estimated noise memory
1405 multiplex non-linear processor
1421$_0$ to 1421$_{M-1}$ 5048 divider
1485$_0$ to 1485$_{M-1}$ non-linear processor
1501$_0$ to 1501$_{M-1}$ frequency-classified spectral gain modifier
1591,7012$_0$ to 7012$_0$ to 7012$_{M-1}$ maximum-value selector
1592 minimum-spectral-gain memory
1593,5204,5206 threshold memory
1594,5203,5205 comparator
1595,5044 switch
1596 modified-value memory
1802$_0$ to 1802$_{K-1}$ weighting processor
1902$_0$ to 1902$_{K-1}$ phase rotator
5041 register-length memory
5045 shift register
5047 minimum-value selector
5201 logical sum calculator
5207 threshold calculator
7011 constant-value memory
7071$_0$ to 7071$_{M-1}$ weighting adder
7095 constant multiplier

BEST MODE FOR CARRYING OUT THE INVENTION

Figure 2:
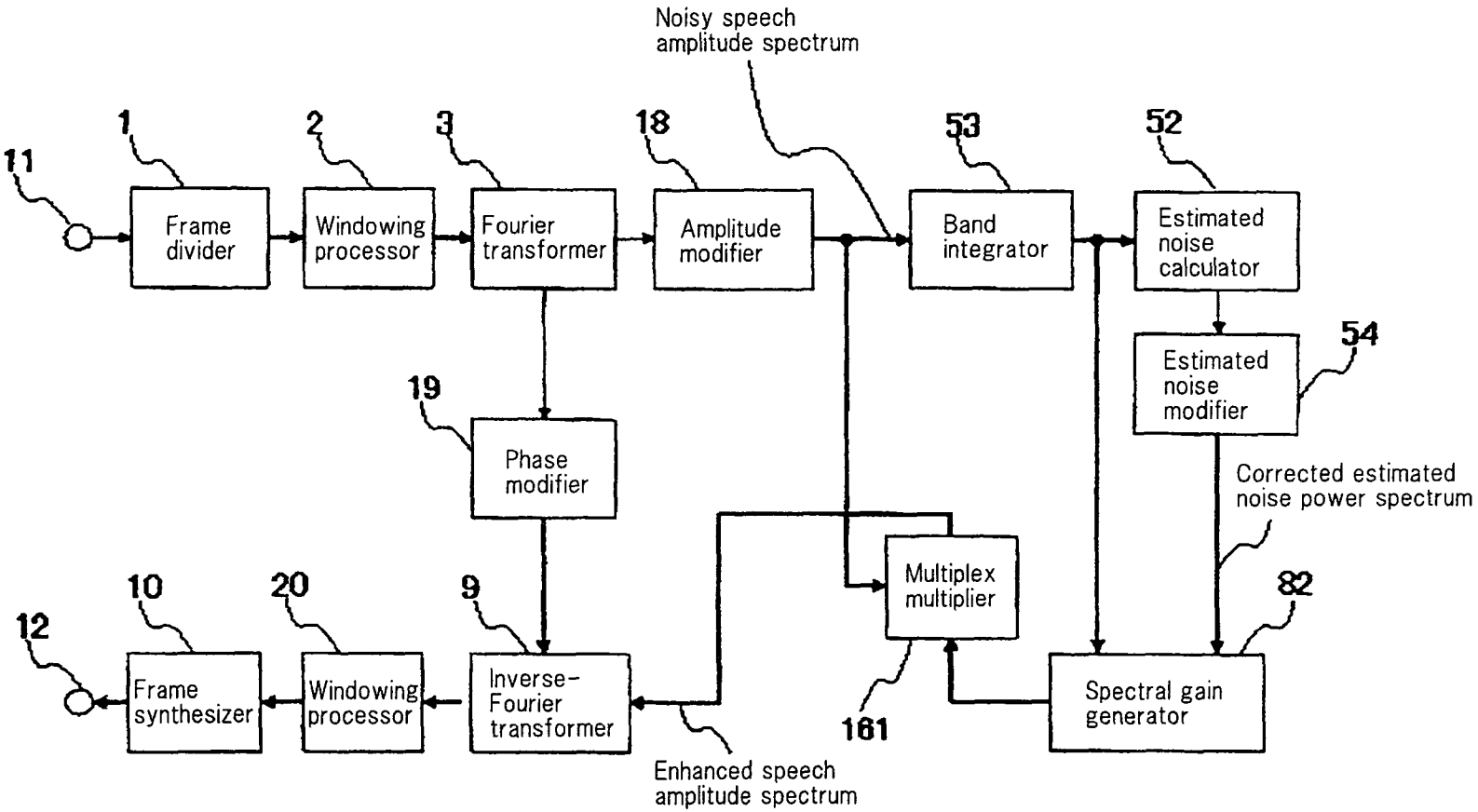
FIG. 2 is a block diagram showing the first embodiment of the present invention.

FIG. 2 is a block diagram showing the first embodiment of the present invention.

The configuration shown in FIG. 2 and the conventional configuration shown in FIG. 1 are the same except for high-pass filter 17, amplitude modifier 18, phase modifier 19, windowing processor 20, band integrator 53, estimated noise modifier 54 and multiplex multiplier 161. The detailed operation will be described herein below focusing on these points of difference.

In FIG. 2, high-pass filter 17 and multiplex multiplier 16 in FIG. 1 are removed, and amplitude modifier 18, phase modifier 19, windowing processor 20, band integrator 53, estimated noise modifier 54 and multiplex multiplier 161 are added instead.

Amplitude modifier 18 and phase modifier 19 are provided to apply frequency response of a high-pass filter to the signal that was converted into frequency domain. Specifically, in FIG. 2, the absolute value (amplitude-frequency response) of function f which is obtained by applying z=exp(j·2pf) to the transfer function of high-pass filter 17 in FIG. 1, applies to the input signal at amplitude modifier 18 and the phase (phase-frequency response) applies to the input signal at phase modifier 19. With this manipulation, it is possible to obtain the same effect as high-pass filter 17 in FIG. 1 is applied to the input signal. That is, instead of convoluting the transfer function of high-pass filter 17 with the input signal in time domain, the input signal is converted through Fourier transformer 3 into frequency domain signals, which then are multiplied by frequency response.

The output from amplitude modifier 18 is supplied to band integrator 53 and multiplex multiplier 161. Band integrator 53 integrates signal samples corresponding to multiple frequency components to reduce the total number and transmits the result to estimated noise calculator 52 and spectral gain generator 82. Upon integration, multiple signal samples are added up and the sum is divided by the number of the added samples to determine the mean value. Estimated noise modifier 54 corrects the estimated noise supplied from estimated noise calculator 52 and transmits the result to spectral gain generator 82.

The most essential operation for making corrections in estimated noise modifier 54 is to multiply all the frequency components by an identical constant. Also, different constants may be used depending on the frequency. A special case is that the constants for particular frequencies are set at 1.0; that is, the data at the frequencies for which the constant is set at 1.0 is not corrected and the data for the frequencies other than that is corrected. This means that selective correction can be made depending on the frequency. It is possible to make correction other than this, by adding a different value depending on the frequency, by performing a non-linear process or the like.

By making the correction as above, it is possible to maintain the speech quality of the enhanced speech to be output high by reducing the deviation from the true value of the estimated noise value generated by band integration. For the aftermentioned band integrating method, it has been made clear by informal subjective evaluation that multiplication of the estimated noise in the band equal to or higher than 1000 Hz by a constant of 0.7 is suitable in sampling at 8 kHz.

The output from phase modifier 19 is transmitted to inverse Fourier transformer 9. The operation from this point forward is the same as that described with FIG. 1. Windowing processor 20 is provided for suppressing intermittent speechs at frame boundaries, as disclosed in patent document 3 (Japanese Patent Application Laid-open 131689/2003).

Figure 3:
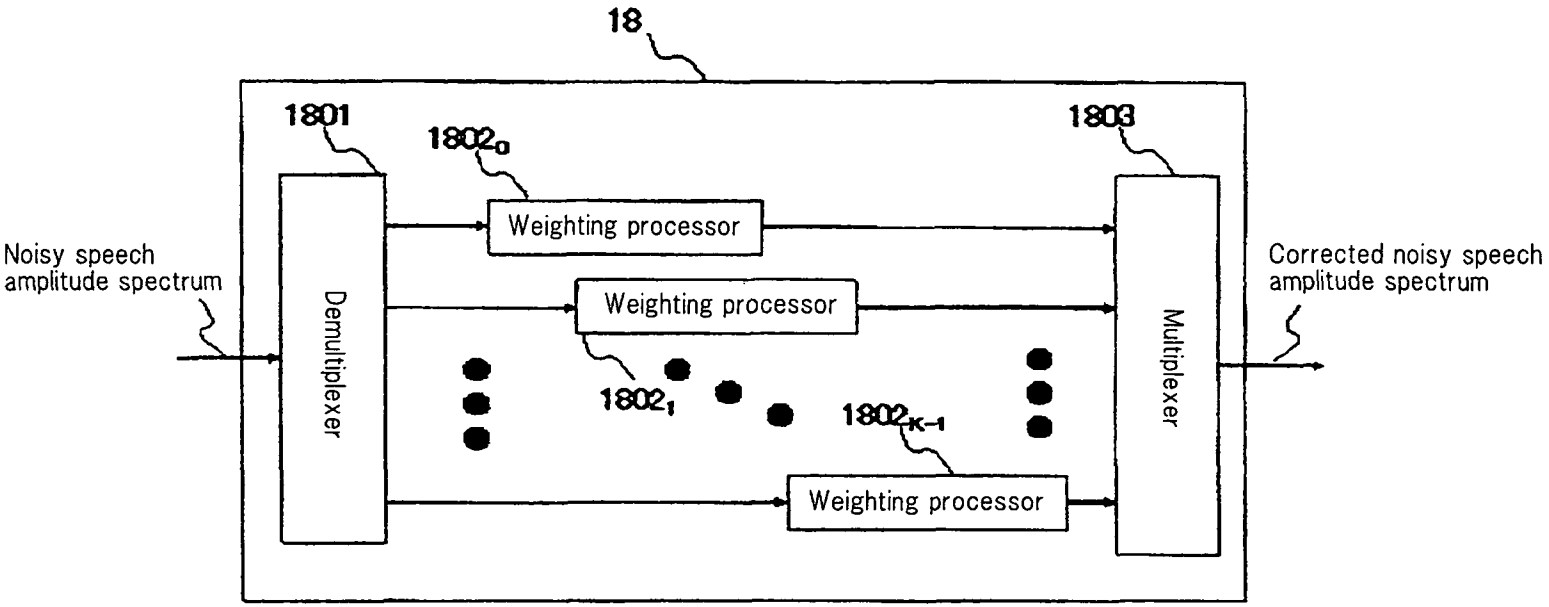
FIG. 3 is a block diagram showing a configuration of an amplitude modifier included in the first embodiment of the present invention.

FIG. 3 shows a configurational example of amplitude modifier 18 of FIG. 2. Herein, the number of independent Fourier transform output components is assumed to be K. The multiplexed noisy speech amplitude spectrum supplied from Fourier transformer 3 is transmitted to demultiplexer 1801. Demultiplexer 1801 decomposes the multiplexed noisy speech amplitude spectrum into individual frequency components and transmits them to weighting processors 1802$_0$ to 1802$_{K-1}$. Weighting processors 1802$_0$ to 1802$_{K-1}$ weight the noisy speech amplitude spectra that were decomposed for individual frequency components, with corresponding amplitude frequency responses and transmit the result to multiplexer 1803. Multiplexer 1803 multiplexes the signals transferred from weighting processors 1802$_0$ to 1802$_{K-1}$ and outputs the result as a corrected noisy speech amplitude spectrum.

Figure 4:
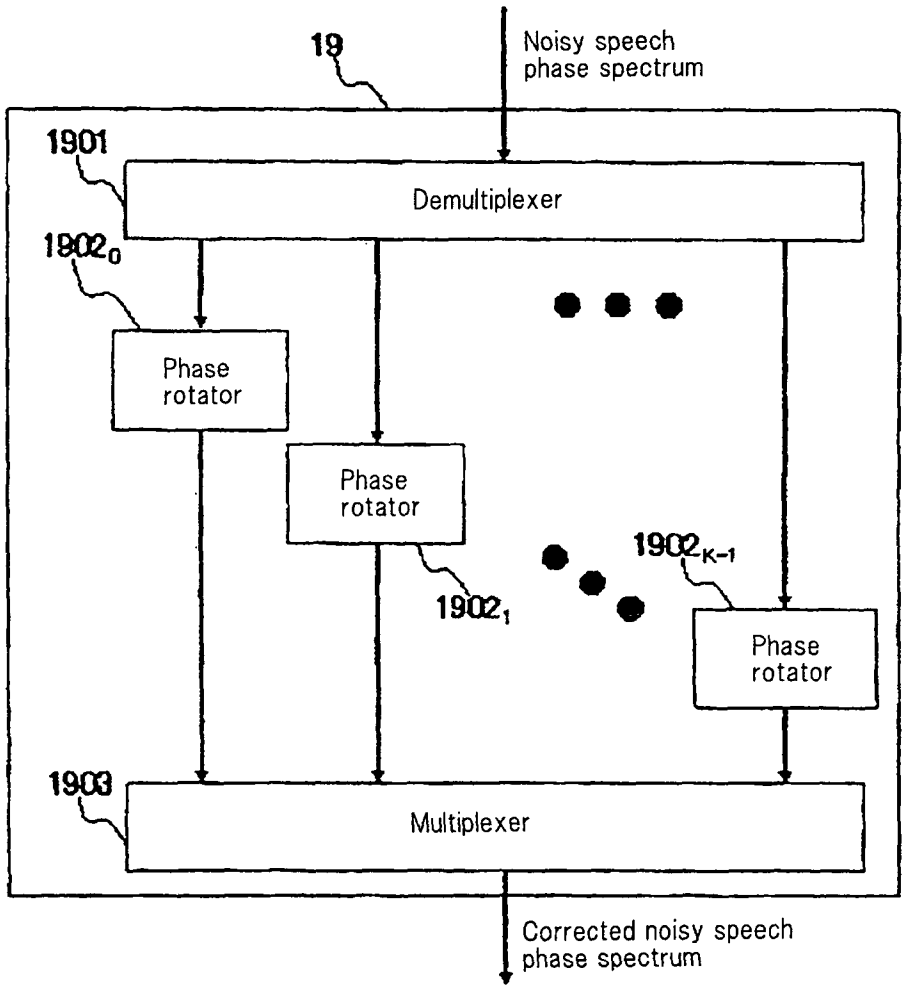
FIG. 4 is a block diagram showing a configuration of a phase modifier included in the first embodiment of the present invention.

FIG. 4 shows a configurational example of phase modifier 19 of FIG. 2. The multiplexed noisy speech phase spectrum supplied from Fourier transformer 3 is transmitted to demultiplexer 1901. Demultiplexer 1901 decomposes the multiplexed noisy speech phase spectrum into individual frequency components and transmits them to phase rotators 1902$_0$ to 1902$_{K-1}$. Phase rotators 1902$_0$ to 1902$_{K-1}$ rotate the noisy speech phase spectra that were decomposed for individual frequency components, in accordance with corresponding phase frequency responses and transmit the result to multiplexer 1903. Multiplexer 1903 multiplexes the signals transferred from phase rotators 19020 to 1902K−1 and outputs the result as a corrected noisy speech phase spectrum.

Figure 5:
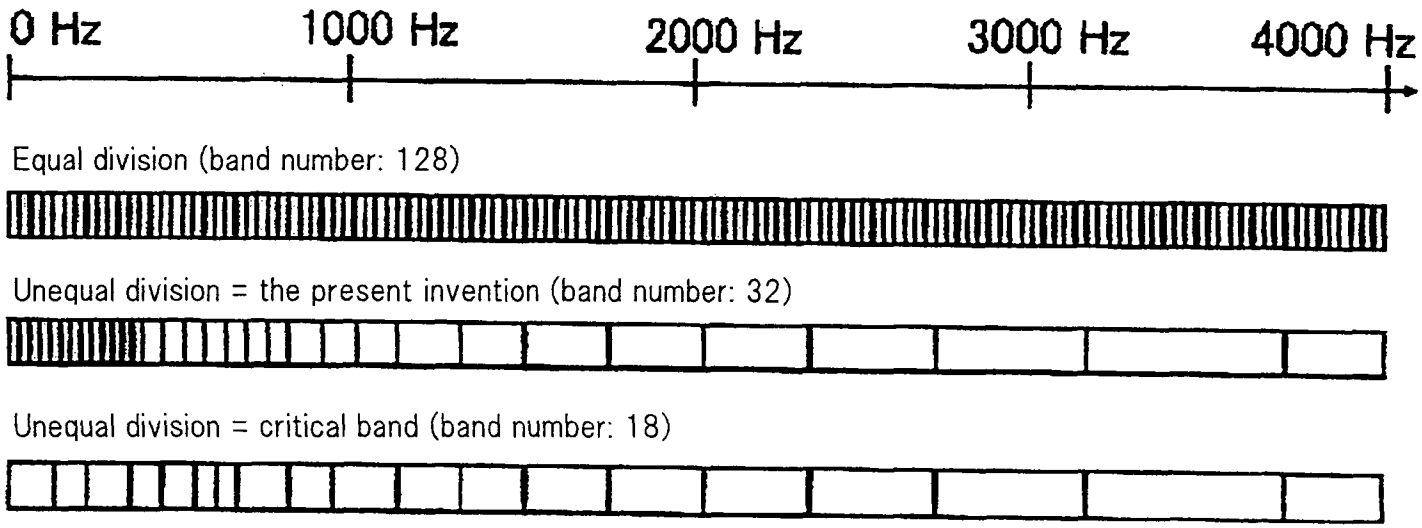
FIG. 5 is a chart for explaining integration of frequency samples.

FIG. 5 is a chart for explaining how multiple frequency samples are integrated by band integrator 53 of FIG. 2. Shown here is a case of 8 kHz sampling, that is, a case where a signal having a band of 4 kHz is Fourier transformed with a block length L. In accordance with patent document 1, noisy speech signal samples that were Fourier transformed arise as many number as block length L of the Fourier transform. However, the number of the independent components is the half of these samples, i.e., L/2.

In the present invention, these L/2 samples are partly integrated to reduce the number of independent frequency components. To do this, a greater number of samples are integrated into one sample in the higher frequency range. That is, many frequency components are integrated into one as their frequencies become higher, that is, the band is divided unequally. As an example of such unequal division, the octave division in which the band becomes narrower toward the lower band side having powers of 2, the critical band division in which the band is divided based on the human auditory characteristics, and others are known. Concerning the details of the critical band, non-patent document 1 (pp. 158 to 164 in PSYCHOACOUSTICS, 2ND ED., SPRINGER, January 1999) can be referred to.

In particular, the band division, based on a critical band, has been widely used since it presents high consistency with human auditory characteristics. In 4 kHz band, the critical band consists of, in total, 18 bands. In contrast, in the present invention, the lower range is divided into narrower bands than those in the case of the critical band as shown in FIG. 5, so as to prevent deterioration of noise suppressing characteristics. The present invention is characterized in that the frequency range higher than 1156 Hz to 4 kHz is divided into bands in the same manner as in the critical band division, but the range lower than that is divided into narrower bands.

FIG. 5 shows an example with L=256. The frequency components from the direct current to the thirteenth component are not integrated, and the frequency components are handed independently as they are. The following fourteen components are integrated, two by two, into seven groups. The six components that follow are integrated, three by three, into two groups. Then, the following four components are integrated into one group. Thereafter, the components are integrated in correspondence to the case of the critical band.

The integration of frequency components as above makes it possible to reduce the number of independent frequency components from 128 to 32. The correspondence between the 128 frequency components after Fourier transform and the 32 frequency components after integration is shown in Table 1. Since the bandwidth for one frequency component is 4000/128=31.25 Hz, the corresponding frequencies calculated based on this is shown in the right-most column.

TABLE 1

| Generation of unequally divided sub-bands by frequency component integration | | |
|---|---|---|
| Band No. | Frequency component No. (the number of components) | Frequency [Hz] |
| 0 | 0(1) | 0·31 |
| 1 | 1(1) | 31·62 |
| . . . | . . . | . . . |

TABLE 1-continued

| Generation of unequally divided sub-bands by frequency component integration | | |
|---|---|---|
| Band No. | Frequency component No. (the number of components) | Frequency [Hz] |
| 12 | 12(1) | 375·406 |
| 13 | 13-14(2) | 406·469 |
| 14 | 15-16(2) | 469·531 |
| 15 | 17-18(2) | 531·594 |
| 16 | 19-20(2) | 594·656 |
| 17 | 21-22(2) | 656·719 |
| 18 | 23-24(2) | 719·781 |
| 19 | 25-26(2) | 781·844 |
| 20 | 27-29(3) | 844·938 |
| 21 | 30-32(3) | 938·1031 |
| 22 | 33-36(4) | 1031·1156 |
| 23 | 37-42(6) | 1156·1344 |
| 24 | 43-48(6) | 1344·1531 |
| 25 | 49-56(8) | 1531·1781 |
| 26 | 57-65(9) | 1781·2063 |
| 27 | 66-75(10) | 2063·2375 |
| 28 | 76-87(12) | 2375·2750 |
| 29 | 88-101(14) | 2750·3188 |
| 30 | 102-119(18) | 3188·3750 |
| 31 | 120-128(9) | 3750·4000 |

(fs = 8 kHz)

It is important in the operation of band integrator 53 that frequency components are not integrated for the frequencies below approximately 400 Hz. If frequency components in this frequency range are integrated, the resolution is lowered resulting in degradation of speech quality. On the other hand, in the frequencies above about 1156 Hz, frequency components may be integrated in conformity with the critical band. When the band of the input signal becomes wider, it is necessary to maintain speech quality by increasing the block length L of Fourier transform. This is because the bandwidth for one frequency component increases in the aforementioned band equal to or lower than 400 Hz where no frequency components are integrated, causing degradation of resolution. For example, using the case where L=256 and the bandwidth is 4 kHz as the reference, it is possible to maintain the speech quality at the same level as in the case with a bandwidth of 4 kHz even when a broader band signal is used, by determining the block length L of the Fourier transform so that L>fs/31.25 holds. When L is selected as a power of 2 in accordance with this rule, L is determined as L=512 when 8 kHz<fs=16 kHz, L=1024 when 16 kHz<fs=32 kHz and L=2048 when 32 kHz<fs=64 kHz. An example corresponding to Table 1, where fs=16 kHz is shown in Table 2. Table 2 shows one example, and those having band integration boundaries slightly different present the same effect.

TABLE 2

| Generation of unequally divided sub-bands by frequency component integration | | |
|---|---|---|
| Band No. | Frequency component No. (the number of components) | Frequency [Hz] |
| 0 | 0(1) | 0·31 |
| 1 | 1(1) | 31·62 |
| . . . | . . . | . . . |
| 12 | 12(1) | 375·406 |
| 13 | 13-14(2) | 406·469 |
| 14 | 15-16(2) | 469·531 |
| 15 | 17-18(2) | 531·594 |
| 16 | 19-20(2) | 594·656 |
| 17 | 21-22(2) | 656·719 |
| 18 | 23-24(2) | 719·781 |

TABLE 2-continued

| Generation of unequally divided sub-bands by frequency component integration | | |
|---|---|---|
| Band No. | Frequency component No. (the number of components) | Frequency [Hz] |
| 19 | 25-26(2) | 781·844 |
| 20 | 27-29(3) | 844·938 |
| 21 | 30-32(3) | 938·1031 |
| 22 | 33-36(4) | 1031·1156 |
| 23 | 37-42(6) | 1156·1344 |
| 24 | 43-48(6) | 1344·1531 |
| 25 | 49-56(8) | 1531·1781 |
| 26 | 57-65(9) | 1781·2063 |
| 27 | 66-75(10) | 2063·2375 |
| 28 | 76-87(12) | 2375·2750 |
| 29 | 88-101(14) | 2750·3188 |
| 30 | 102-119(18) | 3188·3750 |
| 31 | 119-140(21) | 3750·4406 |
| 32 | 140-169(29) | 4406·5313 |
| 33 | 169-204(35) | 5313·6406 |
| 34 | 204-245(41) | 6406·7688 |
| 35 | 245-255(10) | 7688·8000 |

(fs = 16 kHz)

Figure 6:
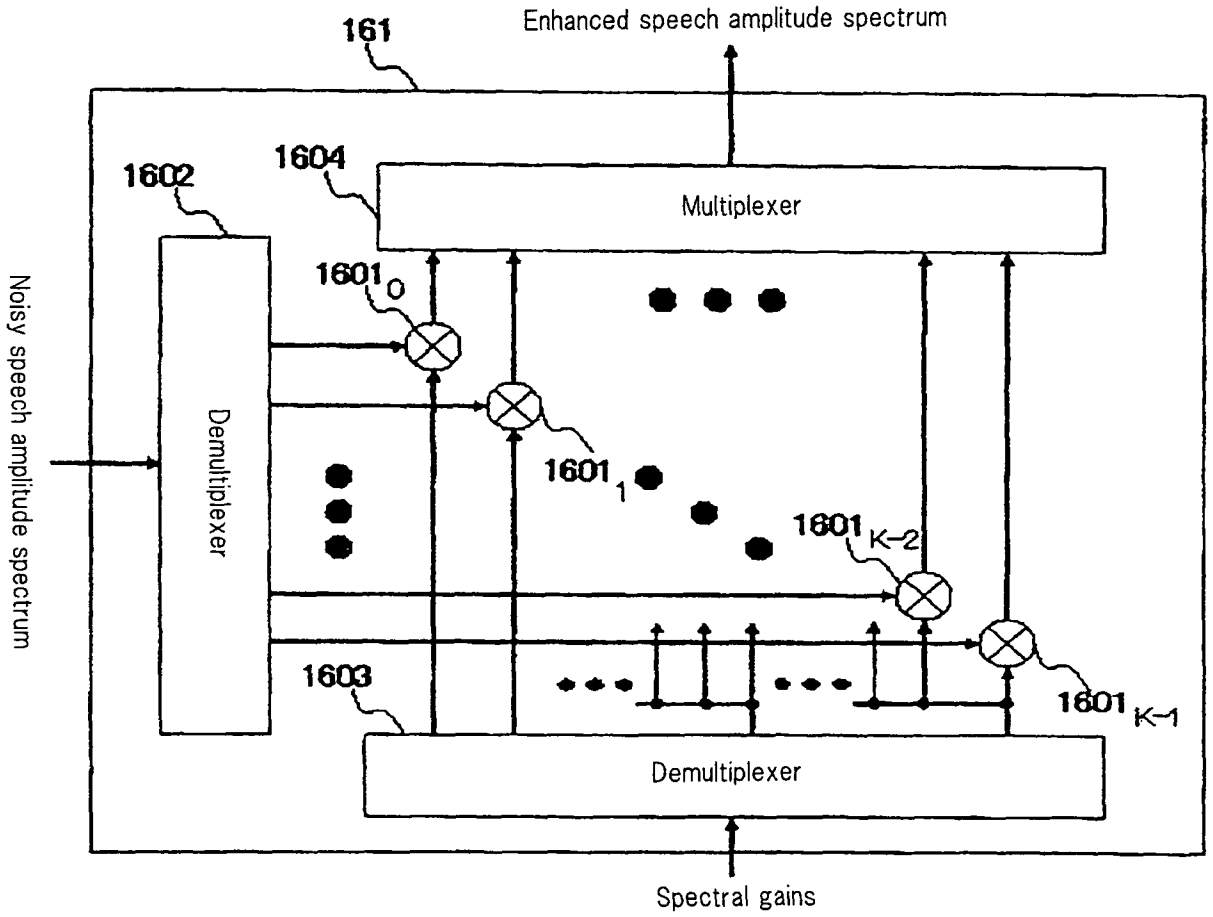
FIG. 6 is a block diagram showing a configuration of a multiplex multiplier included in the first embodiment of the present invention.

FIG. 6 shows a configurational example of multiplex multiplier 161. Multiplex multiplier 161 includes multipliers $\mathbf{1601}_0$ to $\mathbf{1601}_{K-1}$, demultiplexers 1602, 1603 and multiplexer 1604. The corrected noisy speech amplitude spectrum as it is being multiplexed, supplied from amplitude modifier 18 in FIG. 2 is decomposed in demultiplexer 1602 into K samples of individual frequencies, which are supplied to respective multipliers $\mathbf{1601}_0$ to $\mathbf{1601}_{K-1}$. The spectral gains, which are supplied from spectral gain generator 82 in FIG. 2 as being multiplexed are separated by demultiplexer 1603 into individual frequency elements, which are supplied to respective multipliers $\mathbf{1601}_0$ to $\mathbf{1601}_{K-1}$.

The number of the spectral gains classified by frequency is equal to the number of bands integrated in band integrator 53. In other words, a spectral gain corresponding to each sub-band that was integrated by band integrator 53 is separated by demultiplexer 1603.

In the example shown in FIG. 5, the number of the separated spectral gains is 32. The separated spectral gains are supplied to the multipliers that correspond to the band integration pattern in band integrator 53. In the example shown in FIG. 5, a common spectral gain is supplied to a plurality of multipliers in accordance with Table 1.

In the example of Table 1, since K=128, common spectral gains are transmitted to each of multipliers 160127 to 160129, multipliers 160130 to 160132, multipliers 160133 to 160136, multipliers 160137 to 160142, multipliers 160143 to 160148, multipliers 160149 to 160156, multipliers 160157 to 160165, multipliers 160166 to 160175, multipliers 160176 to 160187, multipliers 160188 to 1601101, multipliers 1601102 to 1601119, and multipliers 1601120 to 1601128. Independent spectral gains are transmitted to multipliers 16010 to 160126, individually. Multipliers 16010 to 1601K−1 each multiply the input corrected noisy speech spectrum and input spectral gain and output the result to multiplexer 1604. Multiplexer 1604 multiplexes the input signals to output an enhanced speech amplitude spectrum.

Figure 7:
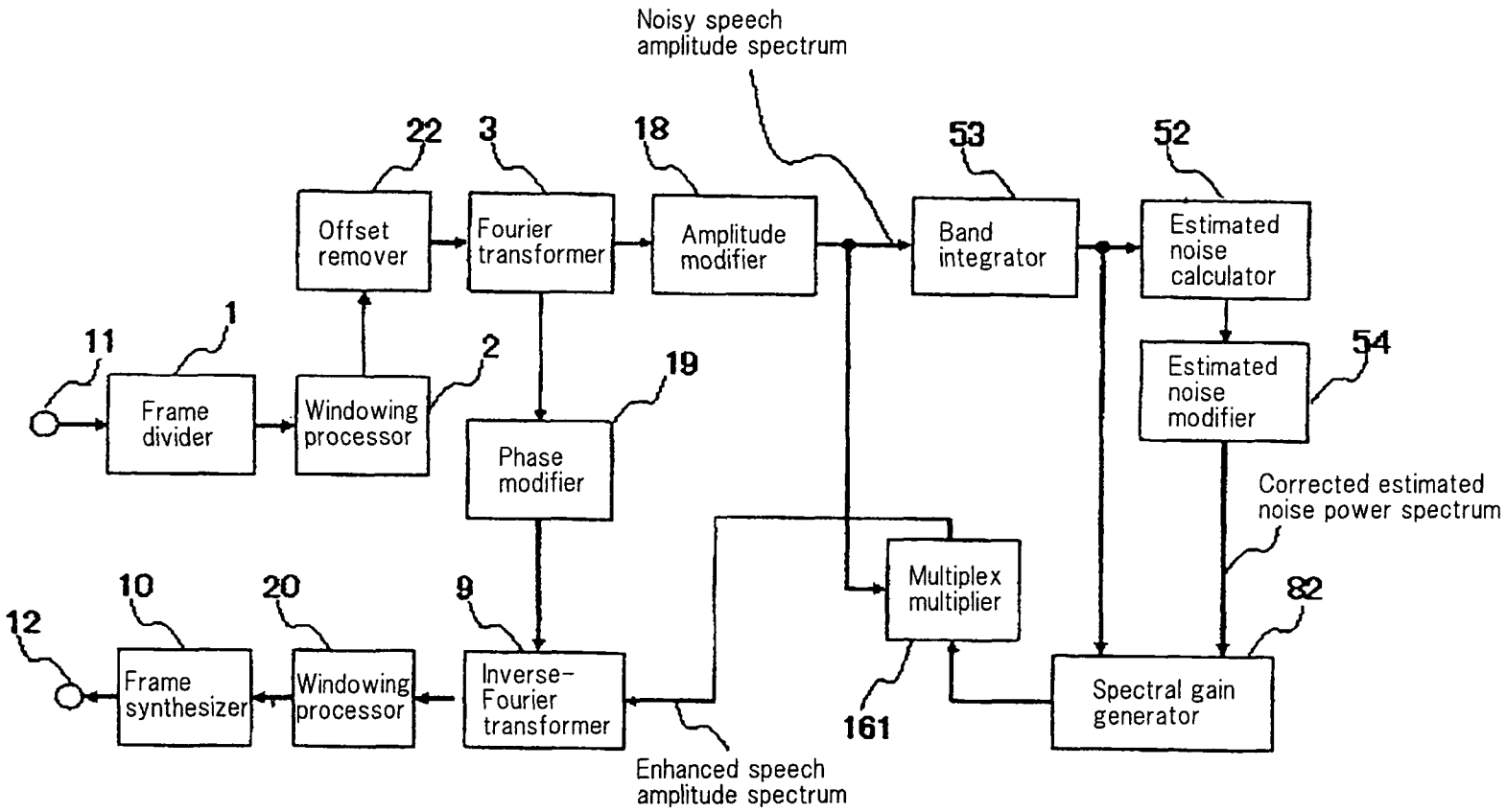
FIG. 7 is a block diagram showing the second embodiment of the present invention.

FIG. 7 is a block diagram showing the second embodiment of the present invention. The difference from the configuration shown in FIG. 2 of the first embodiment is offset remover 22. Offset remover 22 removes the offset from the windowed, noisy speech and outputs the result. The simplest scheme for offset removal is achieved by calculating the means value of noisy speech for every frame to assume it as the offset and subtracting it from all the samples in the frame. It is also possible to average the means values for individual frames, over a multiple number of frames to determine the average value as the offset and substrate it. By offset removal, it is possible to improve transformation accuracy in the following Fourier transformer and hence improve the speech quality of the enhanced speech in the output.

Figure 8:
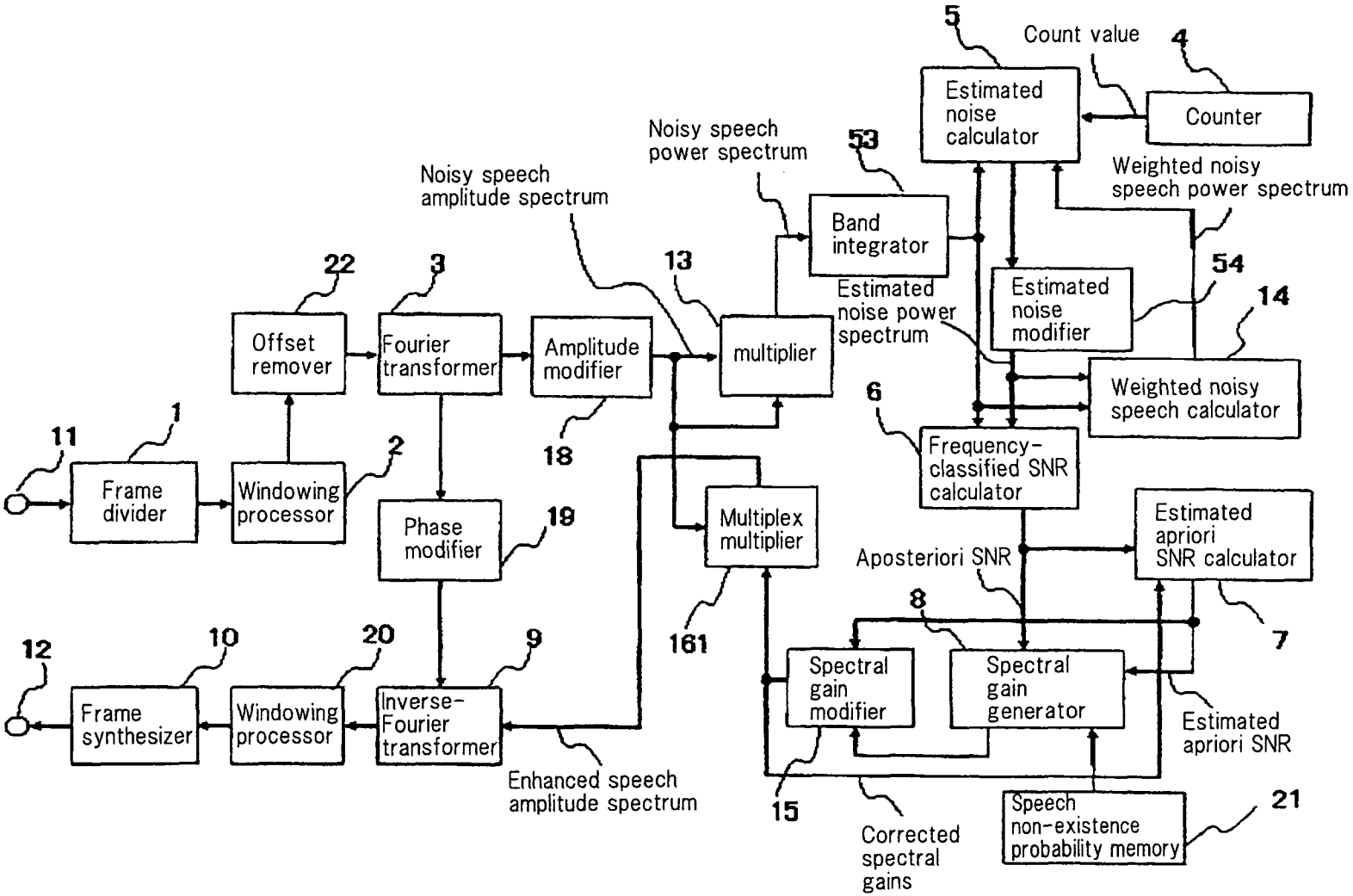
FIG. 8 is a block diagram showing the third embodiment of the present invention.

FIG. 8 is a block diagram showing the third embodiment of the present invention. A noisy speech signal is supplied to input terminal 11 as a sequence of sample values. The noisy speech signal samples are supplied to frame divider 1 and divided into frames each including K/2 samples. Here, K is assumed to be an even number. The noisy speech signal samples divided into frames are supplied to windowing processor 2, where the signal is multiplied by window function w(t). Signal yn(t)bar that is windowed by w(t) for input signal yn(t) (t=0, 1, . . . , K/2−1) of the n-th frame is given as the following equation

[Math 1]

$$\bar{y}_n(t)=w(t)y_n(t) \tag{1}$$

It is also a widely used practice for parts of two consecutive frames to be overlapped and windowed. When the overlap length is assumed to be 50% of the frame length, for t=0, 1, . . . , K/2−1, yn(t)bar (t=0, 1, . . . , K−1) obtained from the following equations:

[Math 2]

$$\bar{y}_n(t)=w(t)y_{n-1}(t+K/2)$$

$$\bar{y}_n(t+K/2)=w(t+K/2)y_n(t) \tag{2}$$

is output from windowing processor 2. For a real number signal, a horizontally symmetrical window function is used. Further, the window function is designed so that the input signal and the output signal when the spectral gain is set at 1 will correspond to each other without calculation error. This means that w(t)+w(t+K/2)=1.

Hereinbelow, description of an example follows in which reference is made to a case in which windowing is done by overlapping consecutive two frames by 50 percent. As w(t), the Hanning window represented by the following equation can be used, for example.

[Math 3]

$$w(t)=\begin{cases}0.5+0.5\cos\left(\dfrac{\pi(t-K/2)}{K/2}\right), & 0\le t<K\\ 0, & K\le t\end{cases} \tag{3}$$

Other than this, various window functions such as the Hamming window, the Kaiser window, the Blackman window and the like are known. The windowed output, yn(t)bar is supplied to offset remover 22, where the offset is removed. The detail of offset removal is the same as that already described with reference to FIG. 7. The signal after offset removal is supplied to Fourier transformer 3, where it is transformed into noisy speech spectrum Yn(k). Noisy speech spectrum Yn(k) is separated into phase and amplitude; noisy speech phase spectrum arg Yn(k) is supplied to inverse Fourier transformer 9 by way of phase modifier 19 and noisy speech amplitude spectrum |Yn(k)| is supplied to multiplex multiplier 13 and multiplex multiplier 16 by way of amplitude modifier 18. The operations of phase modifier 19 and amplitude modifier 18 are the same as those already described with reference to FIG. 2.

Multiplex multiplier 13 calculates a noisy speech power spectrum based on the amplitude-corrected, noisy speech amplitude spectrum and transmits it to band integrator 53. Band integrator 53 partly integrates the noisy speech power spectrum so as to reduce the number of independent frequency components, then transmits the result to estimated noise calculator 5, frequency-classified SNR (signal to noise ratio) calculator 6 and weighted noisy speech calculator 14. The operation of band integrator 53 is the same as that already described with reference to FIG. 2. Weighted noisy speech calculator 14 calculates a weighted noisy speech power spectrum based on the noisy speech power spectrum supplied from multiplex multiplier 13 and transmits the result to estimated noise calculator 5. Estimated noise calculator 5 estimates the power spectrum of noise based on the noisy speech power spectrum, the weighted noisy speech power spectrum and the count value from counter 4 and transmits the result as an estimated noise power spectrum to frequency-classified SNR calculator 6.

Frequency-classified SNR calculator 6 calculates SNRs for individual frequency bands based on the input noisy speech power spectrum and estimated noise power spectrum, and supplies the results as aposteriori SNRs to estimated apriori SNR calculator 7 and spectral gain generator 8.

Estimated apriori SNR calculator 7 estimates apriori SNRs based on the input aposteriori SNRs and the corrected spectral gains supplied from spectral gain modifier 15 and transmits the result as estimated apriori SNRs to spectral gain generator 8. Spectral gain generator 8 receives as its input the aposteriori SNRs, the estimated apriori SNRs and the speech non-existence probability supplied from speech non-existence probability memory 21, generates spectral gains based on these inputs, and transmits the results as the spectral gains to spectral gain modifier 15.

Spectral gain modifier 15 corrects the spectral gains using the input estimated apriori SNRs and spectral gains and supplies corrected spectral gains Gn(k)bar to multiplex multiplier 161. Multiplex multiplier 161 weights the corrected, noisy speech amplitude spectra supplied from Fourier transformer 3 by way of amplitude modifier 18 using corrected spectral gains Gn(k)bar supplied from spectral gain modifier 15 to thereby determine enhanced speech amplitude spectra |Xn(k)|bar, and transfers them to inverse Fourier transformer 9. |Xn(k)|bar is represented by the following equation.

[Math 4]

$$|\overline{X}_n(k)=\overline{G}_n(k)H_n(k)|Y_n(k)| \tag{4}$$

Here, Hn(k) is a correction gain in amplitude modifier 18, having characteristics simulating the amplitude frequency response of high-pass filter 17.

Inverse Fourier transformer 9 multiplies the enhanced speech amplitude |Xn(k)|bar supplied from multiplex multiplier 161 by the corrected noisy speech phase spectrum arg Yn(k)+arg Hn(k) supplied from Fourier transformer 3 via phase modifier 19 to determine enhanced speech Xn(k)bar. That is,

[Math 5]

$$\overline{X}_n(k)=|\overline{X}_n(k)|\cdot\{argY_n(k)+argH_n(k)\} \tag{5}$$

is executed. Here, arg Hn(k) is the corrected phase in phase modifier 19, having characteristics that simulate the phase frequency response of high-pass filter 17.

The obtained Xn(k)bar is inverse Fourier transformed to produce a time-domain sample sequence (t=0, 1, . . . , K−1) consisting of K samples xn(t)bar for one frame and output it to windowing processor 20, where it is multiplied with window function w(t). Signal xn(t)bar that is windowed by w(t) for input signal xn(t) (t=0, 1, . . . , K/2−1) is given as the following equation.

[Math 6]

$$\overline{x}_n(t)=w(t)x_n(t) \tag{6}$$

It is also a widely used practice that consecutive two frames are partly overlapped to window. If the overleap length is assumed to be 50 percent of the frame length, for t=0, 1, . . . , K/2−1, yn(t)bar (t=0, 1, . . . , K−1), obtained by the following equations is output from windowing processor 20 and transmitted to frame synthesizer 10.

[Math 7]

$$\overline{x}_n(t)=x(t)x_{n-1}(t+K/2)$$

$$\overline{x}_n(t+K/2)=w(t+K/2)x_n(t) \tag{7}$$

Frame synthesizer 10 extracts K/2 samples from each of the neighboring two frames of xn(t)bar, and by the following equation

[Math 8]

$$\hat{x}_n(t)=\overline{x}_{n-1}(t+K/2)+\overline{x}_n(t) \tag{8}$$

enhanced speech xn(t)hut is obtained. The obtained enhanced speech xn(t)hut (t=0, 1, . . . , K−1) is output from frame synthesizer 10 and transmitted to output terminal 12.

Figure 9:
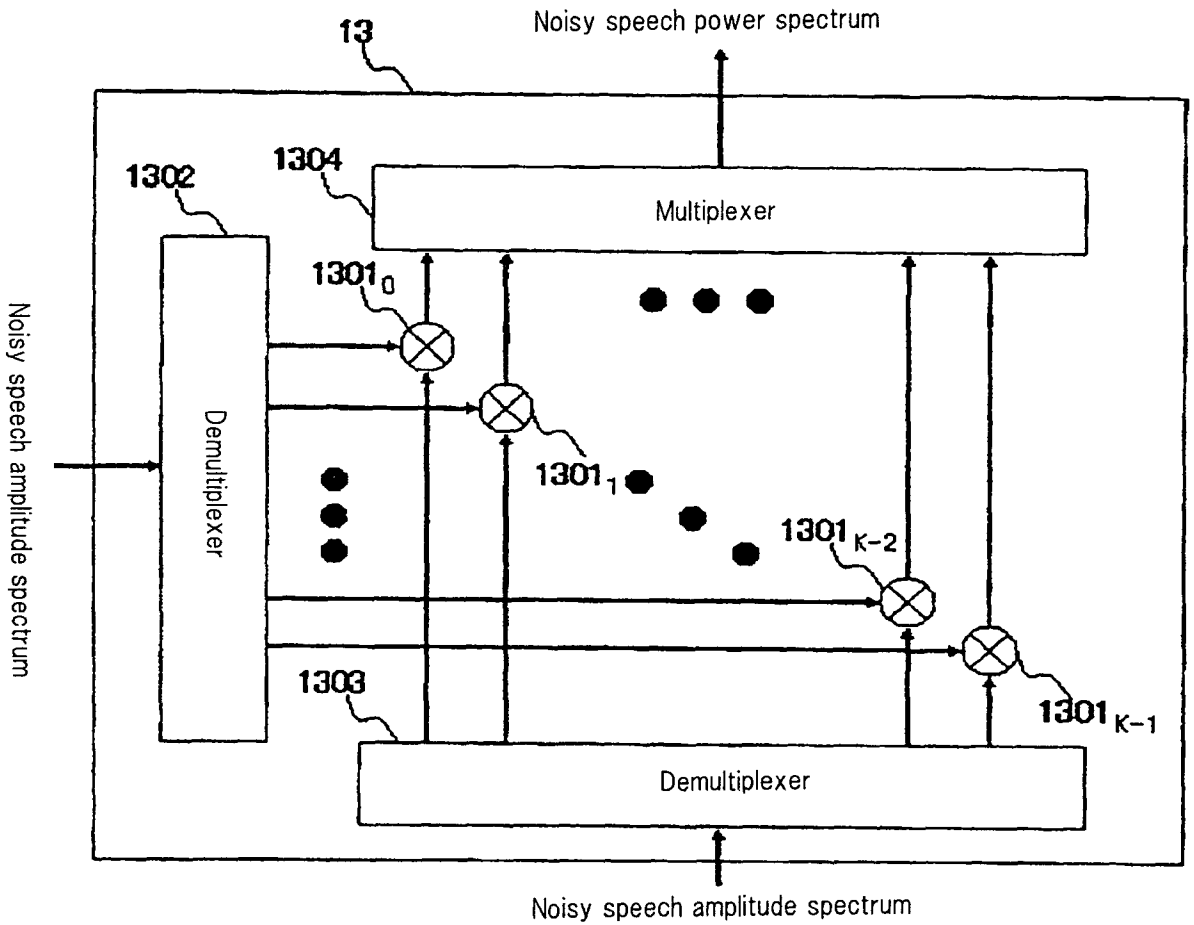
FIG. 9 is a block diagram showing a configuration of a multiplex multiplier included in the third embodiment of the present invention.

FIG. 9 is a block diagram showing the configuration of multiplex multiplier 13 shown in FIG. 8. Multiplex multiplier 13 includes multipliers $\mathbf{1301}_0$ to $\mathbf{1301}_{K-1}$, demultiplexers 1302 and 1303 and multiplexer 1304. The corrected, noisy speech amplitude spectrum, as it is being multiplexed and supplied from amplitude modifier 18 in FIG. 8, is separated into frequency-classified K samples by demultiplexers 1302 and 1303, and the separated samples are supplied to each of multipliers $\mathbf{1301}_0$ to $\mathbf{1301}_{K-1}$. Multipliers $\mathbf{1301}_0$ to $\mathbf{1301}_{K-1}$ square the input signal and transmit the result to multiplexer 1304. Multiplexer 1304 multiplexes the input signals and output the multiplexed signal as a noisy speech power spectrum.

Figure 10:
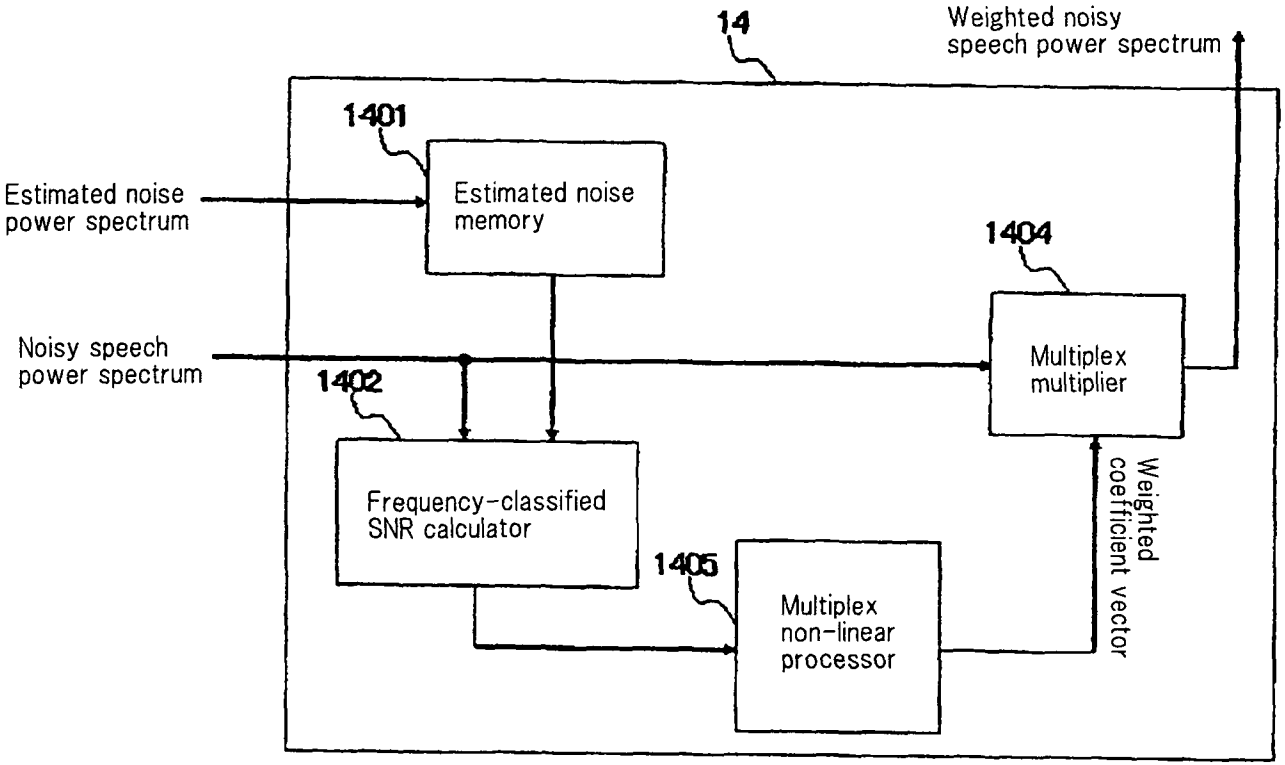
FIG. 10 is a block diagram showing a configuration of a weighted noisy speech calculator included in the third embodiment of the present invention.

FIG. 10 is a block diagram showing the configuration of weighted noisy speech calculator 14. Weighted noisy speech calculator 14 includes estimated noise memory 1401, frequency-classified SNR calculator 1402, multiplex non-linear processor 1405 and multiplex multiplier 1404. Estimated noise memory 1401 stores the estimated noise power spectrum supplied from estimated noise calculator 5 in FIG. 8 and outputs the estimated power spectrum stored one frame before, to frequency-classified SNR calculator 1402. Frequency-classified SNR calculator 1402, based on the estimated noise power spectrum supplied from estimated noise memory 1401 and the noisy speech power spectrum supplied from band integrator 53 in FIG. 8, determines SNRs for individual frequency bands and outputs them to multiplex non-linear processor 1405.

Multiplex non-linear processor 1405, based on the SNRs supplied from frequency-classified SNR calculator 1402, calculates a weight coefficient vector and outputs the weight coefficient vector to multiplex multiplier 1404. Multiplex multiplier 1404 calculates the product of the noisy speech power strum supplied from band integrator 53 in FIG. 8 and the weight coefficient vector supplied from multiplex non-linear processor 1405, for every frequency band, and outputs a weighted noisy speech power spectrum to estimated noise memory 5 in FIG. 8. The configuration of multiplex multiplier 1404 is the same as that of multiplex multiplier 13 described with reference to FIG. 9, so that detailed description is omitted.

Figure 11:
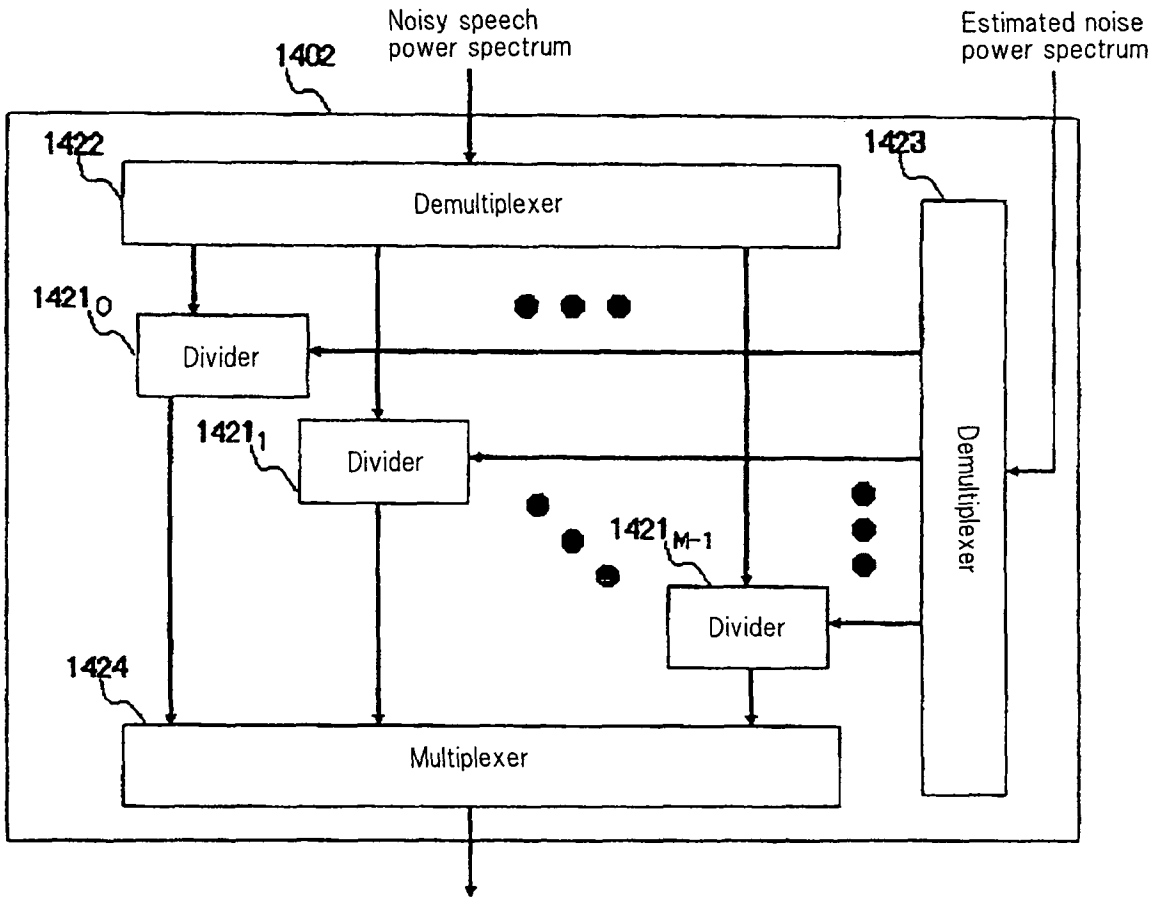
FIG. 11 is a block diagram showing a configuration of a frequency-classified SNR calculator included in FIG. 10.

FIG. 11 is a block diagram showing the configuration of frequency-classified SNR calculator 1402 shown in FIG. 10. Frequency-classified SNR calculator 1402 includes dividers $\mathbf{1421}_0$ to $\mathbf{1421}_{M-1}$, demultiplexers 1422 and 1423 and multiplexer 1424. The noisy speech power spectrum supplied from band integrator 53 in FIG. 8 is transmitted to demultiplexer 1422. The estimated noise power spectrum supplied from estimated noise memory 1401 in FIG. 10 is transmitted to demultiplexer 1423. The noisy speech power spectrum and estimated noise power spectrum are separated by demultiplexer 1422 and demultiplexer 1423, respectively, into M samples corresponding to individual frequency components, and supplied to corresponding dividers $\mathbf{1421}_0$ to $\mathbf{1421}_{M-1}$. These M samples correspond to the sub-bands, each made up of frequency components integrated in band integrator 53. In divider $\mathbf{1421}_0$ to $\mathbf{1421}_{M-1}$, the supplied noisy speech power spectrum is divided by estimated noise power spectrum in accordance with the following equation to determine frequency-classified SNR γn(k)hut, which is transmitted to multiplexer 1424.

[Math 9]

$$\hat{\gamma}_n(k) = \frac{|Y_n(k)|^2}{\lambda_{n-1}(k)} \tag{9}$$

Here, λn−1(k) is the estimated noise power spectratored in the preceding frame. Multiplexer 1424 multiplexes transmitted M frequency-classified SNRs and transmits the result to multiplex non-linear processor 1405 in FIG. 10.

Figure 12:
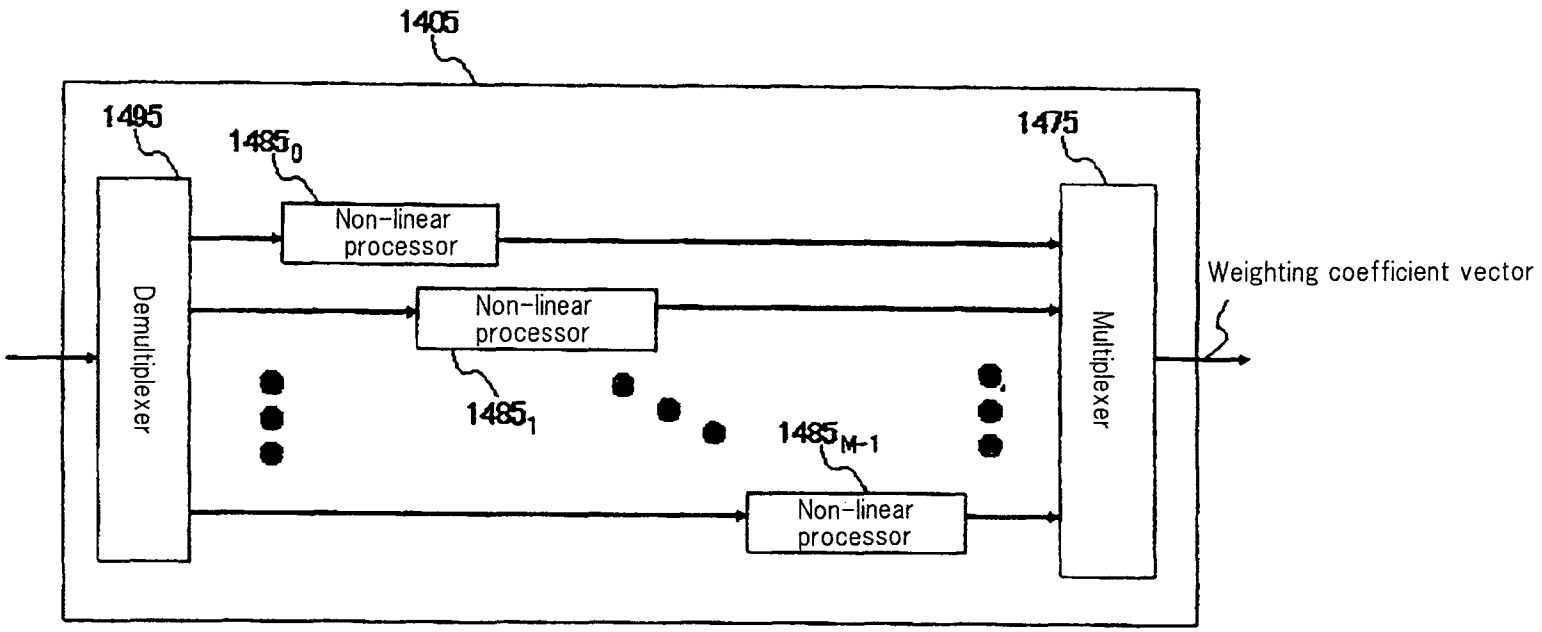
FIG. 12 is a block diagram showing a configuration of a multiplex non-linear processor included in FIG. 10.

Referring next to FIG. 12, the configuration and operation of multiplex non-linear processor 1405 of FIG. 10 will be described in detail. FIG. 12 is a block diagram showing a configuration of multiplex non-linear processor 1405 included in weighted noisy speech calculator 14. Multiplex non-linear processor 1405 includes demultiplexer 1495, non-linear processors $\mathbf{1485}_0$ to $\mathbf{1485}_{M-1}$ and multiplexer 1475. Demultiplexer 1495 separates the SNRs supplied from frequency-classified SNR calculator 1402 in FIG. 10 into frequency-band-classified SNRs and transmits them to non-linear processors $\mathbf{1485}_0$ to $\mathbf{1485}_{M-1}$. Non-linear processors $\mathbf{1485}_0$ to $\mathbf{1485}_{M-1}$ each have a non-linear function that outputs a real number value in accordance with the input value.

Figure 13:
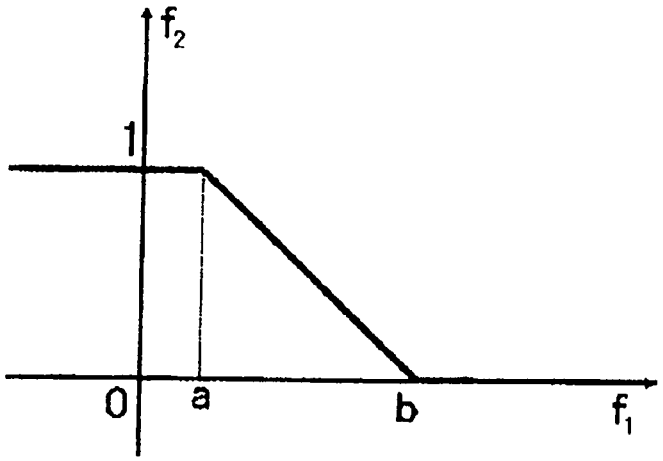
FIG. 13 is a chart showing one example of a non-linear function in a non-linear processor.

FIG. 13 shows an example of a non-linear function. When f1 is an input value, the output value f2 from the non-linear function shown in FIG. 13 is given by the following equation:

[Math 10]

$$f_2 = \begin{cases} 1, & f_1 \le a \\ \dfrac{f_1 - b}{a - b}, & a < f_1 \le b \\ 0, & b < f_1 \end{cases} \tag{10}$$

Here, a and b are arbitrary real numbers.

In each of non-linear processors $\mathbf{1485}_0$ to $\mathbf{1485}_{M-1}$ in FIG. 12, the frequency-band-classified SNR supplied from demultiplexer 1495 is processed by a non-linear function to determine a weight coefficient and the result is output to multiplexer 1475. That is, non-linear processors $\mathbf{1485}_0$ to $\mathbf{1485}_{M-1}$ each output a weight coefficient ranging from 1 to 0 in accordance with the SNR. When the SNR is low, 1 is output and 0 is output when the SNR is high. Multiplexer 1475 multiplexes the weight coefficients output from non-linear processors $\mathbf{1485}_0$ to $\mathbf{1485}_{M-1}$ and outputs the result as a weight coefficient vector to multiplex multiplier 1404.

The weight coefficients, which are used in multiplex multiplier 1404 in FIG. 10 to multiply the noisy speech power spectrum, take values corresponding to the SNRs; the greater the SNR is, i.e., the greater the speech component that is contained in the noisy speech is, the smaller is the value of the weight coefficient. In updating the estimated noise, generally the noisy speech power spectrum is used. However, when the noisy speech power spectrum used for updating estimated noise is weighted in accordance with the SNRs, it is possible to reduce the influence of the speech component contained in the noisy speech power spectrum, and hence to achieve noise estimation with a higher precision. Here, though an example in which the weight coefficients are calculated using non-linear functions is shown, other than non-linear functions, SNR functions represented by other forms such as linear functions, high degree polynomials and the like can be also used.

Figure 14:
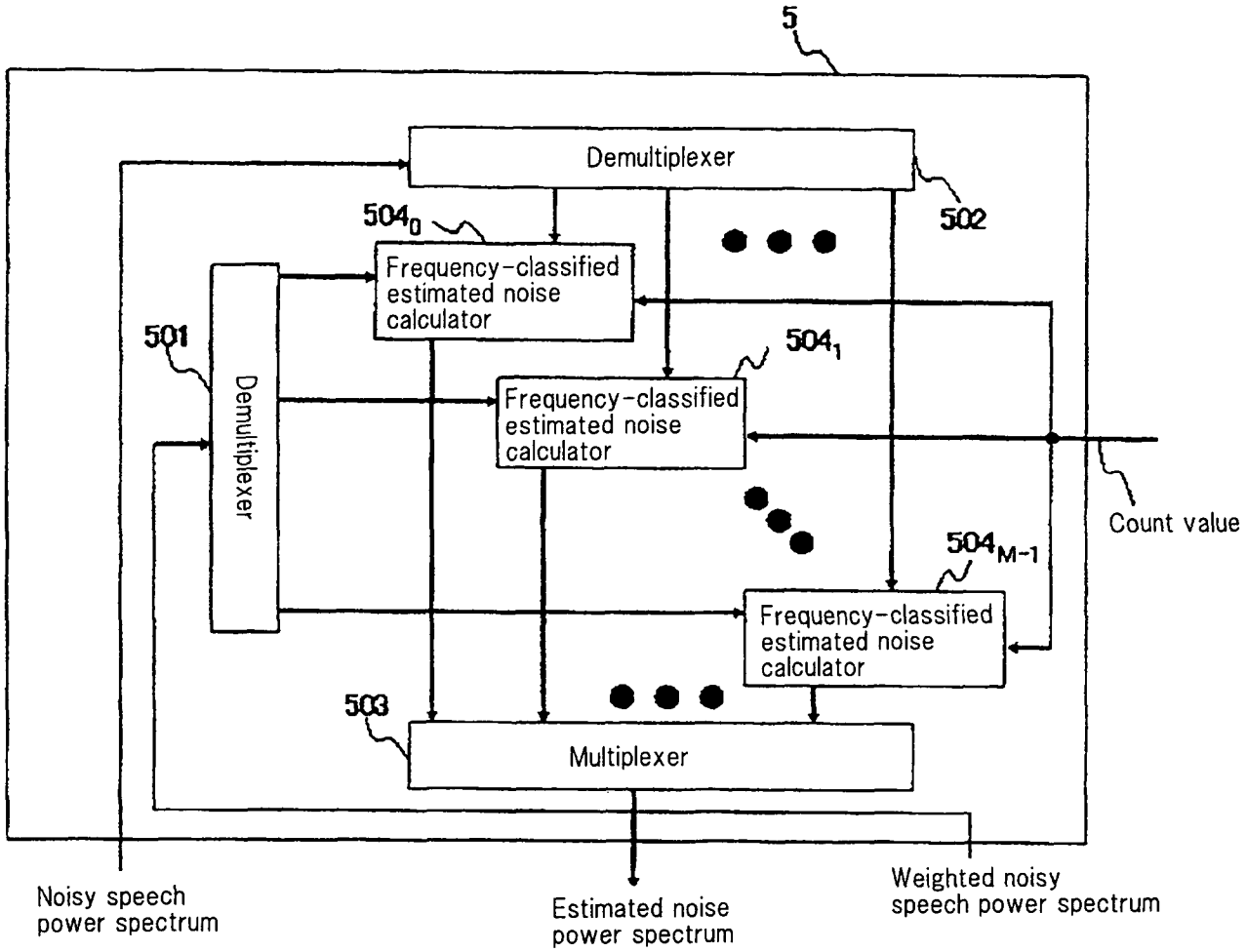
FIG. 14 is a block diagram showing a configuration of an estimated noise calculator included in the third embodiment of the present invention.

FIG. 14 is a block diagram showing a configuration of estimated speech noise calculator 5 shown in FIG. 8. Noise estimating calculator 5 includes demultiplexers 501, 502, multiplexer 503 and frequency-classified estimated noise calculators 5040 to 504M−1. Demultiplexer 501 separates the weighted noisy speech power spectrum supplied from weighted noisy speech calculator 14 in FIG. 8 into frequency-band-classified weighted noisy speech power spectra and supplies them to each of frequency-classified estimated noise calculators 5040 to 504M−1. Demultiplexer 502 separates the noisy speech power spectrum supplied from band integrator 53 in FIG. 8 into frequency-band-classified noisy speech power spectra and supplies them to each of frequency-classified estimated noise calculators $\mathbf{504}_0$ to $\mathbf{504}_{M-1}$.

Frequency-classified estimated noise calculators $\mathbf{504}_0$ to $\mathbf{504}_{M-1}$ calculate frequency-classified estimated noise power spectra from the frequency-band-classified weighted noisy speech power spectra supplied from demultiplexer 501, the frequency-band-classified noisy speech power spectra supplied from demultiplexer 502 and the count value supplied from counter 4 in FIG. 8 and output them to multiplexer 503. Multiplexer 503 multiplexes the frequency-classified estimated noise power spectra supplied from frequency-classified estimated noise calculators $\mathbf{504}_0$ to $\mathbf{504}_{M-1}$ and outputs the estimated noise power spectrum to frequency-classified SNR calculator 6 and weighted noisy speech calculator 14 in FIG. 8. The configuration and operation of frequency-classified estimated noise calculators $\mathbf{504}_0$ to $\mathbf{504}_{M-1}$ will be described in detail with reference to FIG. 15.

Figure 15:
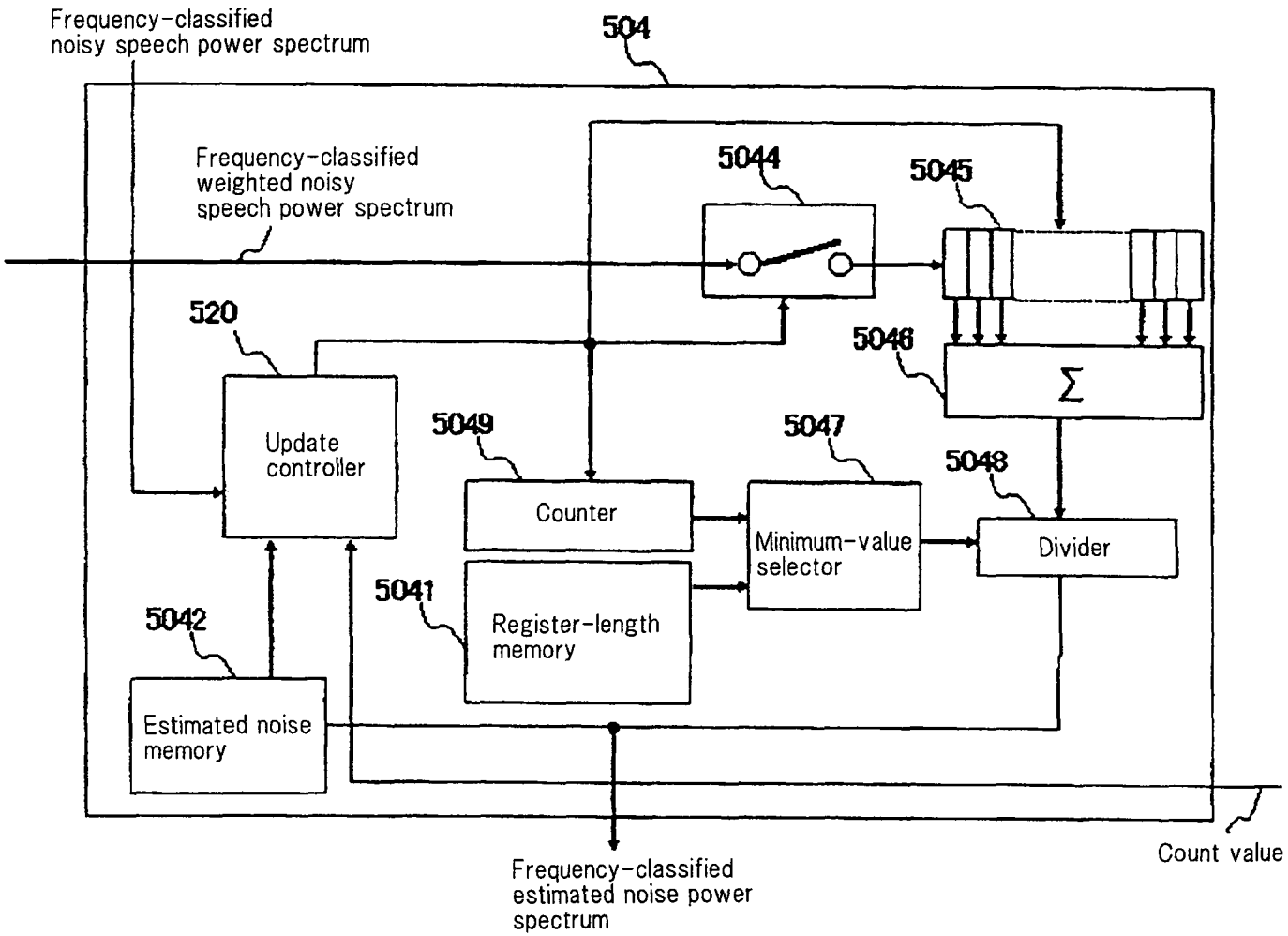
FIG. 15 is a block diagram showing a configuration of a frequency-classified estimated noise calculator included in FIG. 11.

FIG. 15 is a block diagram showing a configuration of frequency-classified estimated noise calculators $\mathbf{504}_0$ to $\mathbf{504}_{M-1}$ shown in FIG. 14. Frequency-classified estimated noise calculator 504 includes update controller 520, register-length memory 5041, estimated noise memory 5042, switch 5044, shift register 5045, adder 5046, minimum-value selector 5047, divider 5048 and counter 5049. Switch 5044 is supplied with frequency-classified weighted noisy speech power spectrum from demultiplexer 501 in FIG. 14. When switch 5044 closes the circuit, the frequency-classified weighted noisy speech power spectrum is transmitted to shift register 5045. Shift register 5045, in accordance with the control signal supplied from update controller 520, shifts the stored values in the internal register to the neighboring register. The shift register length is equal to the value stored in register-length memory 5041, which will be described later. All the register outputs from shift register 5045 are supplied to adder 5046. Adder 5046 adds all the supplied register outputs and transmits the result to divider 5048.

On the other hand, update controller 520 is supplied with the count value, the frequency-classified noisy speech power spectrum and frequency-classified estimated noise power spectrum. Update controller 520 constantly outputs "1" until the count value reaches a predetermined set value. After the predetermined set value is reached, update controller 520 outputs "1" when the input noisy speech signal is determined to be noise and outputs "0" otherwise, and transmits the result to counter 5049, switch 5044 and shifter register 5045. Switch 5044 closes and opens the circuit when the signal supplied from update controller 520 is "1" and "0", respectively. Counter 5049 increases the count value when the signal supplied from update controller 520 is "1" and does not change the count value when the supplied signal is "0". Shift register 5045 picks up one sample of the signal samples supplied from switch 5044 when the signal supplied from update controller 520 is "1" and at the same time shifts the stored values in the internal register to the neighboring register. Supplied to minimum-value selector 5047 are the output from counter 5049 and the output from register-length memory 5041.

Minimum-value selector 5047 selects the smaller one form among the supplied count value and register length, and transmits it to divider 5048. Divider 5048 divides the sum of the frequency-classified noisy speech power spectra, supplied from adder 5046, by the smaller one form among the count value and the register length, and outputs the quotient as frequency-classified estimated noise power spectrum $\lambda n(k)$. When Bn(k) (n=0, 1, . . . , N−1) is assumed to be the sample value of the noisy speech power spectrum stored in shift register 5045, $\lambda n(k)$ is given as follows:

[Math 11]

$$\lambda_n(k) = \frac{1}{N}\sum_{n=0}^{N-1} B_n(k) \tag{11}$$

Here, N is the smaller value between the count value and the register length. Since the count value monotonously increases starting from zero, the division is done with the count value at the beginning and then is done with the register length. The mean value of the values stored in the shift register is determined by dividing by the register length. Since not many values have been stored in shift register 5045, division is done by the number of the registers in which values have been actually stored. The number of the registers in which values are actually stored is equal to the count value when the count value is smaller than the register length and is equal to the register length when the count value is greater than the register length.

Figure 16:
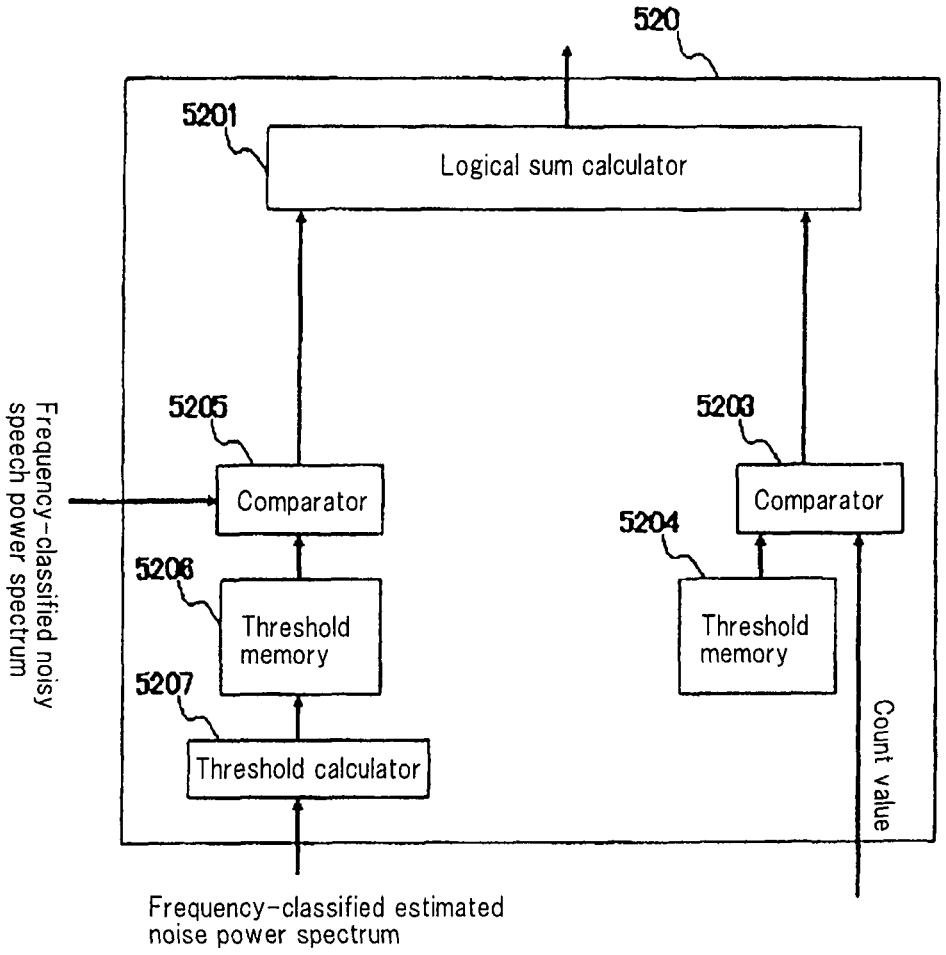
FIG. 16 is a block diagram showing a configuration of an update controller included in FIG. 12.

FIG. 16 is a block diagram showing a configuration of update controller 520 shown in FIG. 15. Update controller 520 includes logical sum calculator 5201, comparators 5203 and 5205, threshold memorys 5204 and 5206 and threshold calculator 5207. The count value supplied from counter 4 in FIG. 8 is transmitted to comparator 5203. The threshold as the output from threshold memory 5204 is also transmitted to comparator 5203. Comparator 5203 makes a comparison between the supplied count value and the threshold and transmits "1" and "0" to logical sum calculator 5201 when the count value is smaller than the threshold and greater than the threshold, respectively. On the other hand, threshold calculator 5207 calculates a value corresponding to the frequency-classified estimated noise power spectrum supplied from estimated noise memory 5042 in FIG. 15 and outputs it as the threshold value to threshold memory 5206.

The simplest way of calculating the threshold value is to multiply the frequency-classified estimated noise power spectrum by a constant. Other than this, it is also possible to calculate the threshold value using a high degree polynomial or a non-linear function. Threshold memory 5206 stores the threshold output from threshold calculator 5207 and outputs the threshold stored in the preceding frame to comparator 5205. Comparator 5205 compares the threshold value supplied from threshold memory 5206 with the frequency-classified noisy speech power spectrum supplied from demultiplexer 502 in FIG. 14, and outputs "1" and "0" to logical sum calculator 5201 when the frequency-classified noisy speech power spectrum is smaller and greater than the threshold, respectively. In short, it determines whether or not the noisy speech signal is noise based on the magnitude of the estimated noise power spectrum. Logical sum calculator 5201 calculates the logical sum between the output value from comparator 5203 and the output value from comparator 5205 and outputs the calculated result to switch 5044, shift register 5045 and counter 5049 in FIG. 15.

In this way, update controller 520 outputs "1" not only for the initial state and silent periods but also when the noisy speech power is low even in non-silent periods. That is, estimated noise is updated. Since the threshold value is calculated for every frequency, it is possible to update estimated noise for every frequency.

Figure 17:
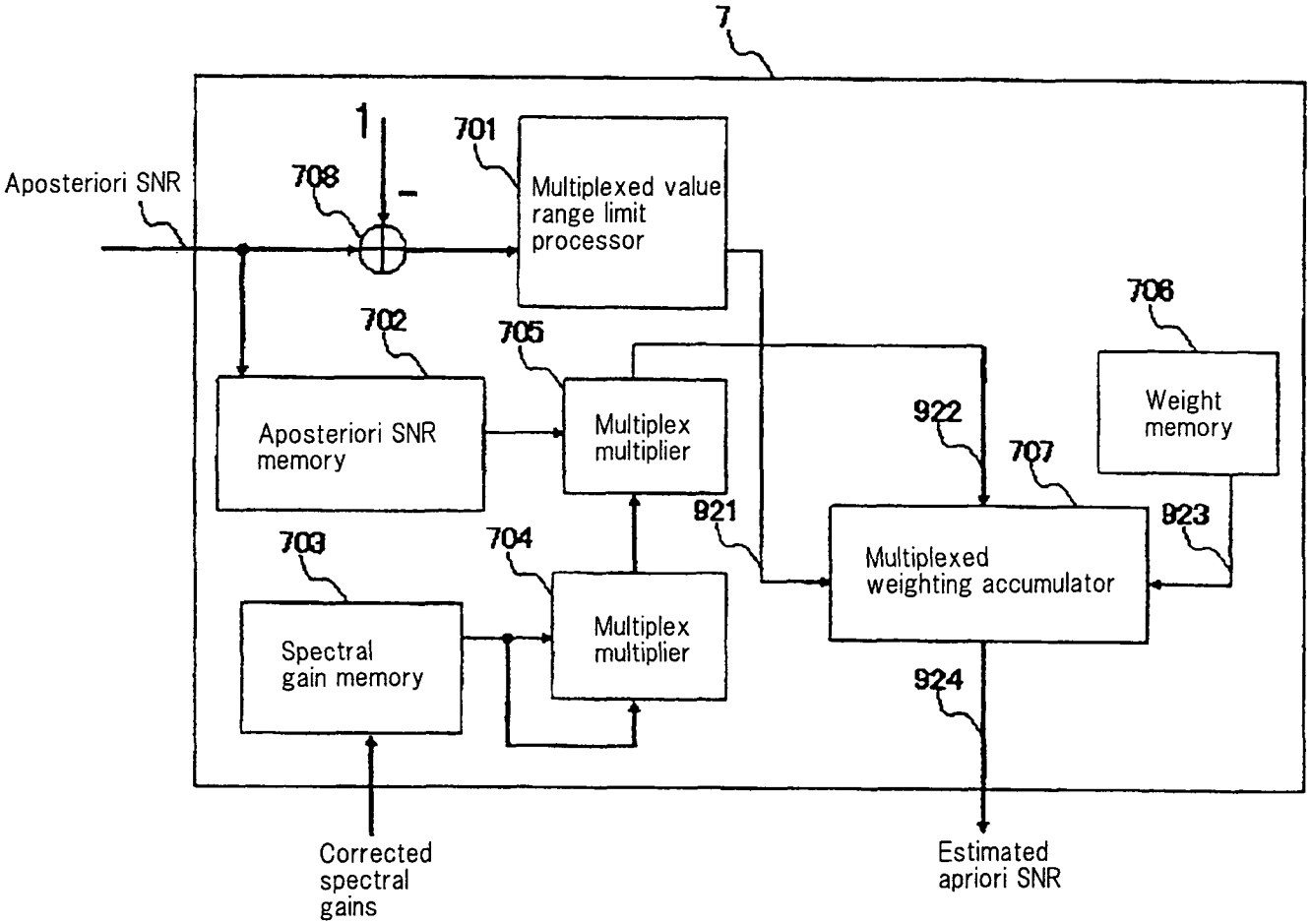
FIG. 17 is a block diagram showing a configuration of an estimated apriori SNR calculator included in the third embodiment of the present invention.

FIG. 17 is a block diagram showing a configuration of estimated apriori SNR calculator 7 shown in FIG. 8. Estimated apriori SNR calculator 7 includes multiplexed value range limit processor 701, aposteriori SNR memory 702, spectral gain memory 703, multiplex multipliers 704 and 705, weight memory 706, multiplexed weighting accumulator 707 and adder 708. Aposteriori SNR $\gamma n(k)$(k=0, 1, . . . , M−1) supplied from frequency-classified SNR calculator 6 in FIG. 8 is transmitted to aposteriori SNR memory 702 and adder 708. Aposteriori SNR memory 702 stores aposteriori SNR $\gamma$(k) in the n-th frame and transmits aposteriori SNR $\gamma n-1(k)$ in the (n−1)-th frame to multiplex multiplier 705.

Corrected spectral gains Gn(k)bar (k=0, 1, . . . , M−1) supplied from spectral gain modifier 15 in FIG. 8 are transmitted to spectral gain memory 703. Spectral gain memory 703 stores corrected spectral gains Gn(k)bar in the n-th frame and transmits corrected spectral gains Gn-1 (k)bar in the (n−1)-th frame to multiplex multiplier 704. Multiplex multiplier 704 squares supplied Gn(k)bar to determine G2n−1 (k)bar and transmits it to multiplex multiplier 705. Multiplex multiplier 705 multiplies G2n−1(k)bar and $\gamma n-1$ (k) for K−0, 1, . . . , M−1 to determine G2n−1 (k)bar: e n−1 (k) and transmits the result to multiplexed weighting accumulator 707 as past estimated SNR 922. The configurations of multiplex multipliers 704 and 705 are the same as that of multiplex multiplier 13 already described with reference to FIG. 9, so that detailed description is omitted.

The other terminal of adder 708 is supplied with −1, and the added result $\gamma n(k)-1$ is transmitted to multiplexed limiter 701. Multiplexed limiter 701 performs an operation on the added result $\gamma n(k)-1$, supplied from adder 708, by value range limit operator p[•] and transmits the result P[γn(k)−1] to adder 707 as temporary estimated SNR 921. Here, P[x] is defined as the following equation.

[Math 12]

$$P[x] = \begin{cases} x, & x > 0 \\ 0, & x \le 0 \end{cases} \tag{12}$$

Supplied also to multiplexed weighting accumulator 707 is weight 923 from weight memory 703. Multiplexed weighting accumulator 707 determines estimated apriori SNR 924 based on the supplied temporary estimated SNR 921, past SNR 922 and weight 923. When weight 923 is represented by a and the estimated apriori SNR is represented by ζ n(k)hut, C n(k)hut is calculated by the following equation.

[Math 13]

$$\hat{\xi}_n(k)=\alpha\gamma_{n-1}(k)\overline{G}_{n-1}^{2}(k)+(1-\alpha)Pf\gamma_n(k)-1] \tag{13}$$

Here, G2−I(k)γ−I(k)bar=I

Figure 18:
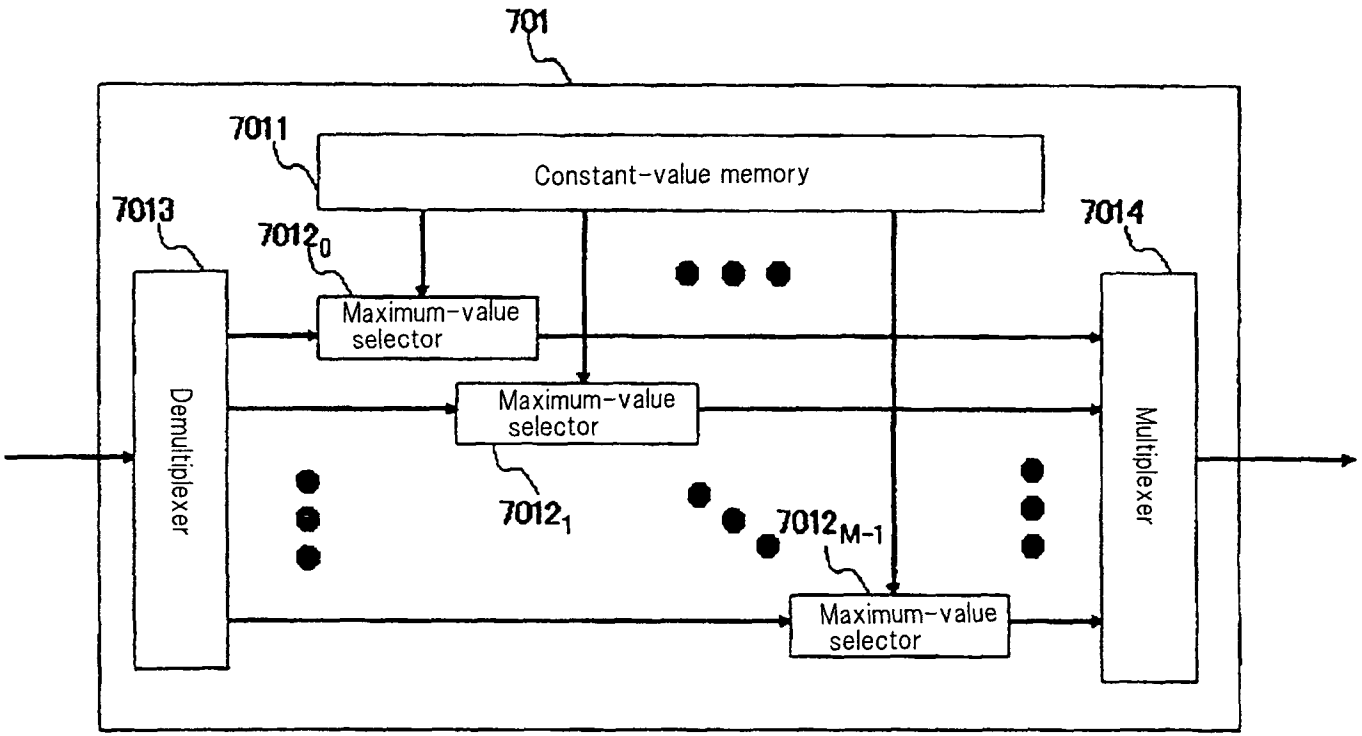
FIG. 18 is a block diagram showing a configuration of a multiplexed limiter included FIG. 14.

FIG. 18 is a block diagram showing a configuration of multiplexed limiter 701 shown in FIG. 17. Multiplexed limiter 701 includes constant-value memory 7011, maximum-value selectors $\mathbf{7012}_0$ to $\mathbf{7012}_{M-1}$, demultiplexer 7013 and multiplexer 7014. Supplied from adder 708 in FIG. 17 to demultiplexer 7013 is γn(k)−1. Demultiplexer 7013 separates the supplied γn(k)−1 into M frequency-band-classified components and supplies them to maximum-value selectors $\mathbf{7012}_0$ to $\mathbf{7012}_{M-1}$. The other inputs of maximum-value selectors $\mathbf{7012}_0$ to $\mathbf{7012}_{M-1}$ are supplied with zero from constant-value memory 7011. Maximum-value selectors $\mathbf{7012}_0$ to $\mathbf{7012}_{M-1}$ compare γn(k)−1 with zero and transmits the greater value to multiplexer 7014. This maximum value select operation corresponds to the execution of aforementioned formula 12. Multiplexer 7014 multiplexes these values and outputs the result.

Figure 19:
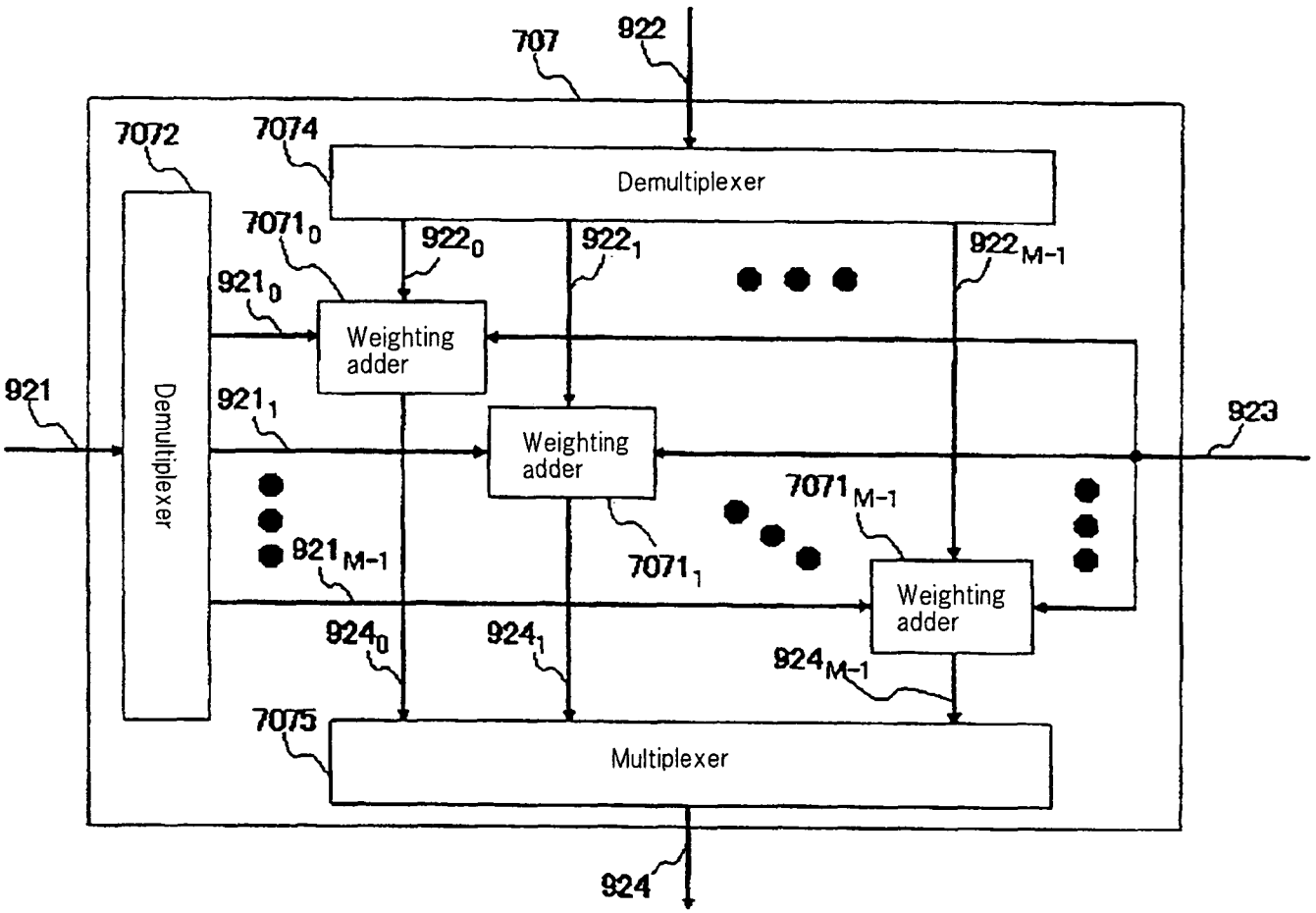
FIG. 19 is a block diagram showing a multiplexed weighting accumulator included in FIG. 14.

FIG. 19 is a block diagram showing a configuration of multiplexed weighting accumulator 707 included in FIG. 17. Multiplexed weighting accumulator 707 includes weighting adders $\mathbf{7071}_0$ to $\mathbf{7071}_{M-1}$, demultiplexers 7072, 7074 and multiplexer 7075. Demultiplexer 7072 is supplied with P[γn(k)−1] from multiplexed limiter 701 in FIG. 17 as temporary estimated SNR 921. Demultiplexer 7072 separates P[γn(k)−1] into M frequency-band-classified components and transmits them as frequency-band-classified temporary estimated SNRs $\mathbf{921}_0$ to $\mathbf{921}_{M-1}$ to weighting adders $\mathbf{7071}_0$ to $\mathbf{7071}_{M-1}$. Demultiplexer 7074 is supplied with G2n−1 (k) bar γn−1 (k) from multiplex multiplier 705 in FIG. 17 as past estimated SNR 922. Demultiplexer 7074 separates G2n−1 (k) bar γn−1 (k) into M frequency-band-classified components and transmits them as past frequency-band-classified estimated SNRs $\mathbf{922}_0$ to $\mathbf{922}_{M-1}$ to weighting adders $\mathbf{7071}_0$ to $\mathbf{7071}_{M-1}$. On the other hand, weight 923 is also supplied to weighting adders $\mathbf{7071}_0$ to $\mathbf{7071}_{M-1}$. Weighting adders $\mathbf{7071}_0$ to $\mathbf{7071}_{M-1}$ execute the weighted addition represented by aforementioned formula 13 and transmit frequency-band-classified estimated apriori SNRs $\mathbf{924}_0$ to $\mathbf{924}_{M-1}$ to multiplexer 7075. Multiplexer 7075 multiplexes frequency-band-classified estimated apriori SNRs 9240 to 924M−1 and outputs the result as estimated apriori SNR 924. The operation and configuration of weighting adders $\mathbf{7071}_0$ to $\mathbf{7071}_{M-1}$ will be described next with reference to FIG. 20.

Figure 20:
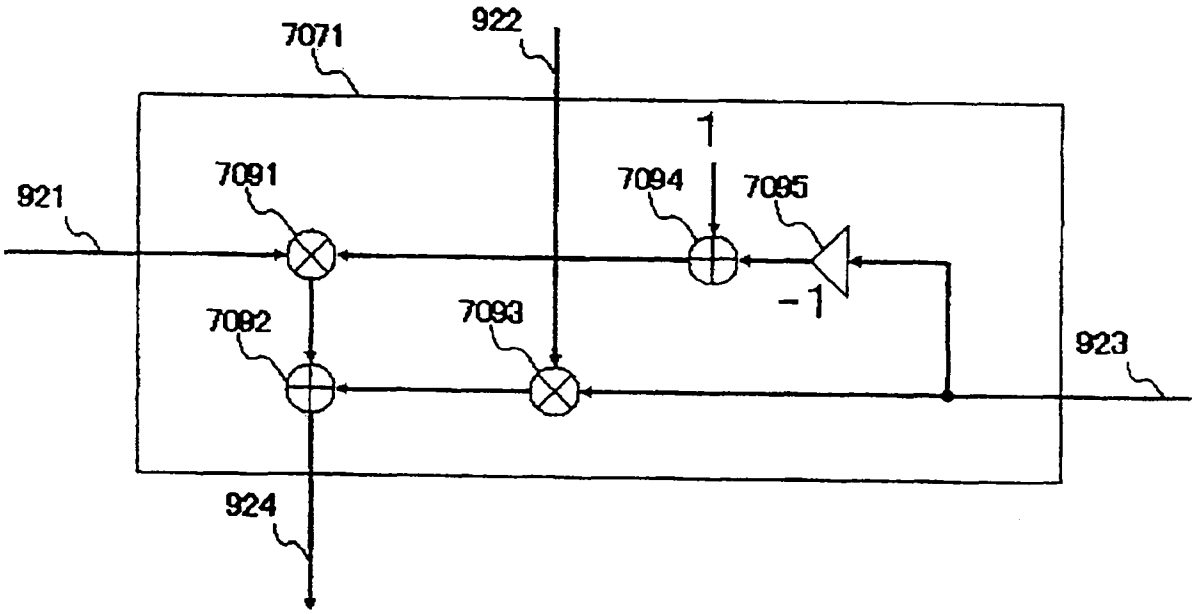
FIG. 20 is a block diagram showing a weighting adder included in FIG. 16.

FIG. 20 is a block diagram showing a configuration of weighting adders $\mathbf{7071}_0$ to $\mathbf{7071}_{M-1}$ shown in FIG. 19. Weighting adder 7071 includes multipliers 7091 and 7093, constant multiplier 7095, adders 7092 and 7094. Frequency-band-classified temporary estimated SNR 921 from demultiplexer 7072 in FIG. 19, past frequency-band-classified SNR 922 from demultiplexer 7074 in FIG. 19 and weight 923 from weight memory 706 in FIG. 17 are supplied as an input. Weight 923 having a value of a is transmitted to constant multiplier 7095 and multiplier 7093. Constant multiplier 7095 multiplies the input signal by −1 and transmits the obtained −α to adder 7094. The other input of adder 7094 is supplied with 1, so that adder 7094 outputs the sum, i.e., 1−α. This output, 1−α, is supplied to multiplier 7091, and multiplied therein by the other input, i.e., frequency-band-classified temporary estimated SNR P[γn(k)−1]. The resultant product, (1−α)P[γn(k)−1] is transmitted to adder 7092. On the other hand, in multiplier 7093, α supplied as weight 923 is multiplied by past estimated SNR 922, and the resultant product, αG2n−1(k) bar γn−1(k) is transmitted to adder 7092. Adder 7092 outputs the sum of (1−α)P[γn(k)−1] and αG2n−1(k) bar γn−1(k) as frequency-band-classified estimated apriori SNR 904.

Figure 21:
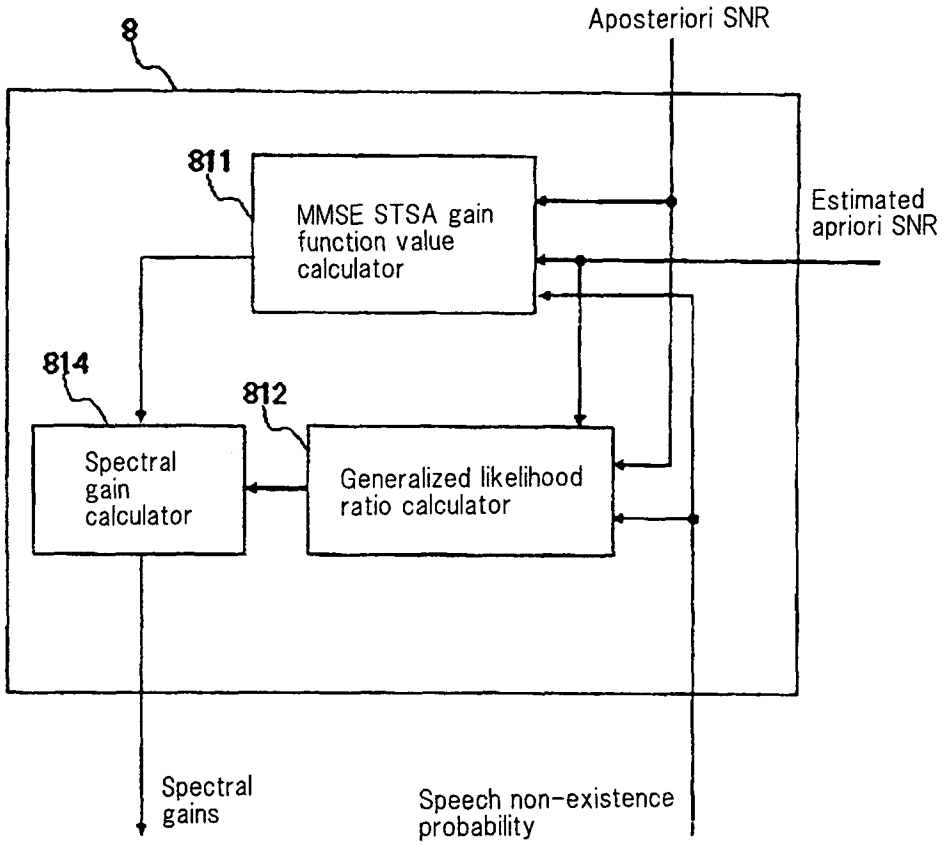
FIG. 21 is a block diagram showing a configuration of a spectral gain generator included in the third embodiment of the present invention.

FIG. 21 is a block diagram showing spectral gain generator 8 shown in FIG. 8. Spectral gain generator 8 includes MMSE STSA gain function value calculator 811, generalized likelihood ratio calculator 812 and spectral gain calculator 814. Hereinbelow, based on the formulae described in non-patent document 2 (IEEE TRANSACTIONS ON ACOUSTICS, SPEECH, AND SIGNAL PROCESSING, VOL. 32, No. 6, PP. 1109-1121, December, 1984), the method of calculating spectral gains will be described.

It is assumed that the frame number is n, the frequency number is k, γn(k) represents the frequency-classified aposteriori SNR supplied from frequency-classified SNR calculator 6 in FIG. 8, ζn(k)hut represents the frequency-classified estimated apriori SNR supplied from estimated apriori SNR calculator 7 in FIG. 8, and q represents the speech non-existence probability supplied from speech non-existence probability memory 21 in FIG. 8. It is also assumed that $$\eta n(k)=\xi n(k)hut/(1-q)$$

$$vn(k)=(\eta n(k)\gamma n(k))/(1+\eta n(k)).$$

MMSE STSA gain function value calculator 811, based on aposteriori SNR γn(k) supplied from frequency-classified SNR calculator 6 in FIG. 8, estimated apriori SNR ζn(k)hut supplied from estimated apriori SNR calculator 7 in FIG. 8 and speech non-existence probability q supplied from speech non-existence probability memory 21 in FIG. 8, calculates an MMSE STSA gain function value for every frequency band and output it to spectral gain calculator 814. Each MMSE STSA gain function value Gn(k) for each frequency band is given as

[Math 14]

$$G_n(k) = \frac{\sqrt{\pi}}{2}\frac{\sqrt{v_n(k)}}{\gamma_n(k)}\exp\left(-\frac{v_n(k)}{2}\right)\left[\begin{array}{c}(1+v_n(k))I_0\left(\frac{v_n(k)}{2}\right)+\\ v_n(k)I_1\left(\frac{V_n(k)}{2}\right)\end{array}\right] \tag{14}$$

Here, I0(z) is the 0-th order modified Bessel function and I1(z) is the 1st order modified Bessel function. Reference to the modified Bessel functions is found in non-patent document 3 (page 374G, Iwanami Shoten, Sugaku-jiten, 1985).

Generalized likelihood ratio calculator 812, based on aposteriori SNR γn(k) supplied from frequency-classified SNR calculator 6 in FIG. 8, estimated apriori SNR ζn(k)hut supplied from estimated apriori SNR calculator 7 in FIG. 8 and speech non-existence probability q supplied from speech non-existence probability memory 21 in FIG. 8, calculates a generalized likelihood ratio for every frequency band and transmits it to spectral gain calculator 814. Generalized likelihood ratio Λn(k) for an individual frequency band is given as:

[Math 15]

$$\Lambda_n(k) = \frac{1-q}{q}\frac{\exp(\nu_n(k))}{1+\eta_n(k)} \tag{15}$$

Spectral gain calculator 814 calculates a spectral gain for every frequency, from MMSE STSA gain function value Gn(k) supplied from MMSE STSA gain function value calculator 811 and generalized likelihood ratio Λn(k) supplied from generalized likelihood ratio calculator 812, and outputs the result to spectral gain modifier 15 in FIG. 8. Spectral gain Gn(k)bar for every frequency band is given as

[Math 16]

$$\overline{G}_n(k) = \frac{\Lambda_n(k)}{\Lambda_n(k)+1}G_n(k) \tag{16}$$

Instead of calculating SNRs for individual frequency bands, it is also possible to determine a common SNR for a broadened band consisting of multiple frequency bands and to use it.

Figure 22:
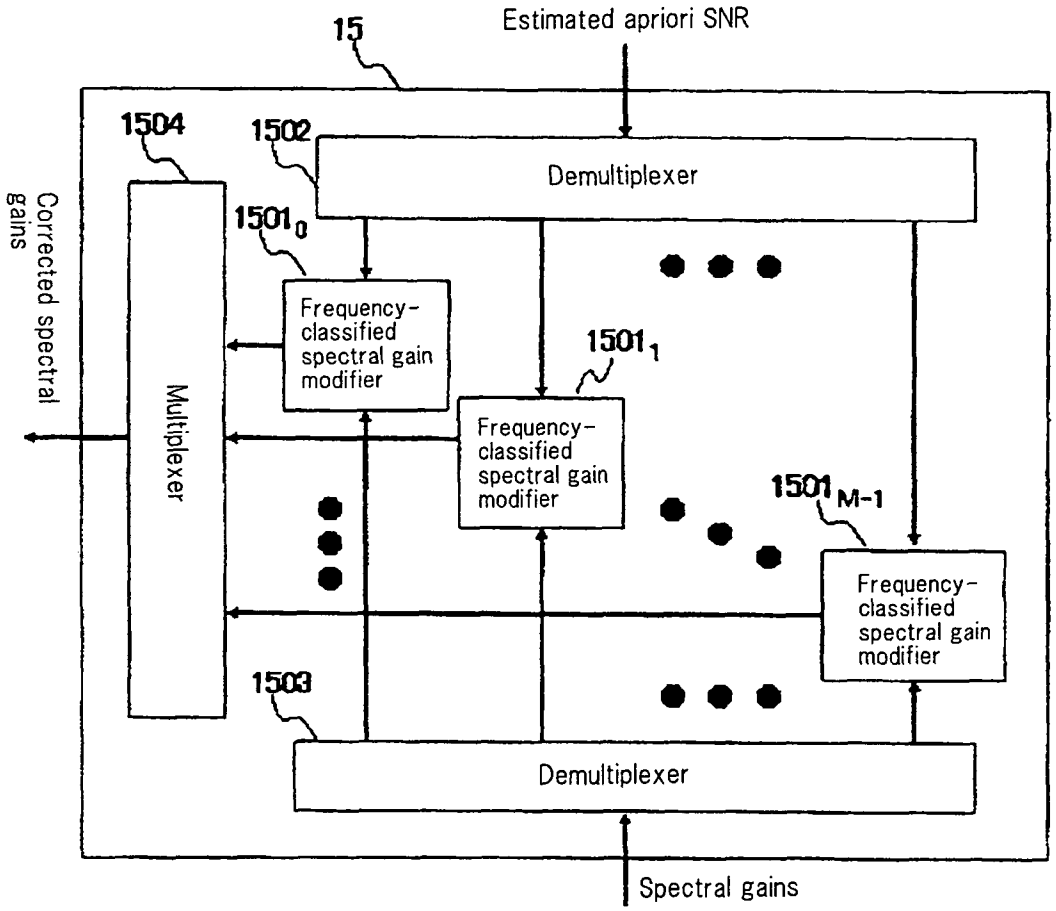
FIG. 22 is a block diagram showing a configuration of a spectral gain modifier included in the third embodiment of the present invention.

FIG. 22 is a block diagram showing a configuration of spectral gain modifier 15 shown in FIG. 8. Spectral gain modifier 15 includes frequency-classified spectral gain modifiers $\mathbf{1501}_0$ to $\mathbf{1501}_{M-1}$, demultiplexers 1502 and 1503 and multiplexer 1504. Demultiplexer 1502 separates estimated apriori SNR supplied from estimated apriori SNR calculator 7 in FIG. 8 into frequency-band-classified components and outputs them to individual frequency-classified spectral gain modifiers $\mathbf{1501}_0$ to $\mathbf{1501}_{M-1}$. Demultiplexer 1503 separates the spectral gains supplied from spectral gain generator 8 in FIG. 8 into frequency-band-classified components and outputs them to individual frequency-classified spectral gain modifiers $\mathbf{1501}_0$ to $\mathbf{1501}_{M-1}$. Frequency-classified spectral gain modifiers $\mathbf{1501}_0$ to $\mathbf{1501}_{M-1}$ calculate frequency-band-classified corrected spectral gains, from frequency-band-classified estimated apriori SNRs supplied from demultiplexer 1502 and frequency-band-classified spectral gains supplied from demultiplexer 1503, and output them to multiplexer 1504. Multiplexer 1504 multiplexes the frequency-band-classified corrected spectral gains supplied from frequency-classified spectral gain modifiers $\mathbf{1501}_0$ to $\mathbf{1501}_{M-1}$ and outputs them as corrected spectral gains to multiplex multiplier 16 and estimated apriori SNR calculator 7 in FIG. 8.

Figure 23:
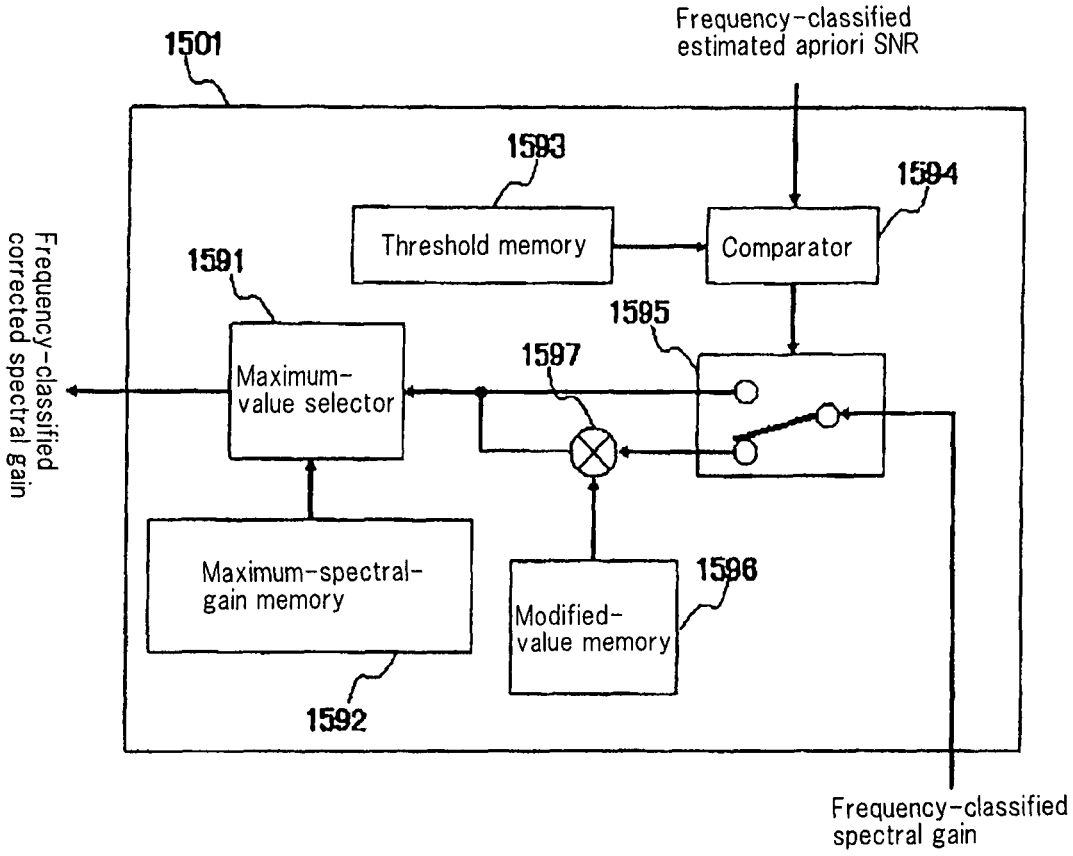
FIG. 23 is a block diagram showing a configuration of a frequency-classified spectral gain modifier included in FIG. 22.

Referring next to FIG. 23, the configuration and operation of frequency-classified spectral gain modifiers $\mathbf{1501}_0$ to $\mathbf{1501}_{M-1}$ will be described in detail.

FIG. 23 is a block diagram showing the configuration of frequency-classified spectral gain modifiers $\mathbf{1501}_0$ to $\mathbf{1501}_{M-1}$ included in spectral gain modifier 15. Frequency-classified spectral gain modifier 1501 includes maximum-value selector 1591, minimum-spectral-gain memory 1592, threshold memory 1593, comparator 1594, switch 1595, modified-value memory 1596 and multiplier 1597. Comparator 1594 makes a comparison between the threshold supplied from threshold memory 1593 and the frequency-band-classified estimated apriori SNR supplied from demultiplexer 1502 in FIG. 22, and supplies "0" and "1" to switch 1595 when the frequency-band-classified estimated apriori SNR is greater and smaller than the threshold, respectively. Switch 1595 outputs the frequency-band-classified estimated apriori SNR supplied from demultiplexer 1503 in FIG. 22 to multiplier 1597 when the output value from comparator 1594 is "1" and to maximum-value selector 1591 and when the output value is "0". More clearly, when frequency-band-classified estimated apriori SNR is smaller than the threshold value, the spectral gain is corrected. Multiplier 1597 calculates the product of the output value from switch 1595 and the output value from modified-value memory 1596 and transmits the product to maximum-value selector 1591.

On the other hand, minimum-spectral-gain memory 1592 supplies the lower limit of the spectral gains that are stored to maximum-value selector 1591. Maximum-value selector 1591 compares the frequency-band-classified spectral gain supplied from demultiplexer 1503 in FIG. 22 or the product calculated by multiplier 1597 with the minimum spectral gain supplied from minimum-spectral-gain memory 1592, and outputs the greater value to multiplexer 1504 in FIG. 22. That is, the spectral gain necessarily takes a greater value than the lower limit being stored in minimum-spectral-gain memory 1592.

Although in all the embodiments described heretofore the least mean square error short period spectrum amplitude method has been assumed as the scheme for suppressing noise, other methods may also be applied. Examples of such methods include the Wiener filtering method, disclosed in non-patent document 4 (PROCEEDINGS OF THE IEEE, VOL. 67, No. 12, PP. 1586-1604, December, 1979), a spectraubtracting method disclosed in non-patent document 5 (IEEE TRANSACTIONS ON ACOUSTICS, SPEECH, AND SIGNAL PROCESSING, VOL. 27, No. 2, PP. 113-129, April, 1979). However, description of detailed configurational examples of these is omitted.

The noise suppressing apparatus of each of the aforementioned embodiments can be configured by a computer apparatus made up of a memory device for storing programs, a control portion equipped with input keys and switches, a display device such as an LCD or the like and a control device that receives input from the control portion and controls the operation of each part. The operation in the noise suppressing apparatus of each of the aforementioned embodiments can be realized by letting the control device execute the program stored in memory. The program may be stored beforehand in memory or may be written in CD-ROM or any other recording medium that the user prefers. It is also possible to provide the program by way of a network.

The invention claimed is:

1. A noise suppressing method for suppressing noise contained in an input signal including a speech or audio signal, comprising the steps of:

transforming the input signal into frequency-domain signals with a first frequency resolution;

integrating the frequency-domain signals to determine subband signals with a second frequency resolution that is smaller than the first frequency resolution, wherein each subband signal comprises a plurality of frequency-domain signals;

determining estimated noise with the second frequency resolution based on the subband signals;

determining a single spectral gain for each subband signal based on the estimated noise; and weighting said frequency-domain signals by said spectral gains wherein the single spectral gain is commonly used for all the plurality of frequency-domain signals of the same subband signal.

2. The noise suppressing method according to claim 1, further comprising the steps of:

correcting said estimated noise to determine corrected estimated noise by multiplying each of the estimated noise by a predetermined value; and determining the spectral gains based on the corrected estimated noise and said subband signals.

3. The noise suppressing method according to claim 1 or 2, further comprising the steps of:

correcting the amplitude of said frequency-domain signals to determine amplitude corrected signals by multiplying each of said frequency-domain signals by a weight predetermined based on an amplitude-frequency response; and integrating the amplitude-corrected signals to determine the subband signals.

4. The noise suppressing method according to claim 3, further comprising the steps of:

correcting the phase of said frequency-domain signals to determine phase corrected signals by rotating a phase of each frequency-domain signal by an angle predetermined based on a phase-frequency response; and transforming the result in which said amplitude corrected signals are weighted by said spectral gains and combined with said phase corrected signals into time-domain signals.

5. The noise suppressing method according to claim 3, further comprising the steps of:

removing an offset of the input signal to determine an offset-free signal; and transforming the offset-free signal into frequency-domain signals.

6. The noise suppressing method according to claim 1, wherein said spectral gains are the same in each integrated frequency domain signal.

7. The noise suppressing method according to claim 1, wherein each integrated frequency-domain signal having a frequency component with a less wider bandwidth than a predetermined frequency domain signal is integrated using one frequency component.

8. The noise suppressing method according to claim 1, wherein at least one integrated frequency-domain signal has a narrower bandwidth than a critical bandwidth.

9. The noise suppressing method according to claim 1, wherein said integrated frequency-domain signals, said estimate noise and said spectral gains correspond to nonuniform frequency bandwidths, one of which, at least, is narrower than a bark band for a corresponding frequency.

10. A noise suppressing apparatus for suppressing noise contained in an input signal including a speech or audio signal, comprising:

a transformer for transforming the input signal into frequency-domain signals with a first frequency resolution;

a band integrator for integrating the frequency-domain signals to determine subband signals with a second frequency resolution that is smaller than the first frequency resolution, wherein each subband signal comprises a plurality of frequency-domain signals;

a noise estimator for determining estimated noise with the second frequency resolution based on the subband signals;

a spectral gain generator for determining a single spectral gain for each subband signal based on the estimated noise and the respective subband signal; and a multiplier for weighting said frequency-domain signals by using said spectral gains wherein the single spectral gain is commonly used for all the plurality of frequency-domain signals of the same subband signal.

11. The noise suppressing apparatus according to claim 10, further comprising:

an estimated noise modifier for correcting said estimated noise to determine corrected estimated noise by multiplying each of the estimated noise by a predetermined value; and a spectral gain generator for determining spectral gains based on the corrected estimated noise and the respective subband signals.

12. The noise suppressing apparatus according to claim 10 or 11, further comprising:

an amplitude modifier for correcting the amplitude of said frequency-domain signals to determine amplitude corrected signals by multiplying each of said frequency-domain signals by a weight predetermined based on an amplitude-frequency response; and a band integrator for integrating the amplitude-corrected signals to determine said subband signals with the second frequency resolution.

13. The noise suppressing apparatus according to claim 12, further comprising:

a phase modifier for correcting the phase of said frequency-domain signals to determine phase corrected signals by rotating a phase of each of said frequency-domain signals by an angle predetermined based on a phase-frequency response; and an inverse transformer for transforming the result in which said amplitude corrected signals are weighted by said spectral gains and combined with said phase corrected signals into time-domain signals.

14. The noise suppressing apparatus according to claim 12, further comprising:

an offset remover for removing an offset of the input signal to determine an offset-free signal; and a transformer for transforming the offset-free signal into frequency domain signals.

15. A non-transitory computer readable storage device embodying a computer program for performing signal processing to suppress noise contained in an input signal including a speech or audio signal, which when executed by a computer causes a computer to execute:

a process for transforming the input signal into frequency-domain signals with a first frequency resolution;

a process for integrating the frequency-domain signals to determine subband signals with a second frequency resolution that is smaller than the first frequency resolution, wherein each subband signal comprises a plurality of frequency-domain signals;

a process for determining estimated noise with the second frequency resolution based on the subband signals;

a process for determining a single spectral gain for each subband signal based on the estimated noise; and a process for weighting said frequency-domain signals by said spectral gains wherein the single spectral gain is commonly used for all the plurality of frequency-domain signals of the same subband signal.

16. The computer readable storage device for suppressing noise according to claim 15, further causing a computer to execute:

a process for correcting said estimated noise to determine corrected estimated noise by multiplying each of the estimated noise by a predetermined value; and a process for determining spectral gains based on the corrected estimated noise and said subband signals.

17. The computer readable storage device for suppressing noise according to claim 15 or 16, further causing a computer to execute:

a process for correcting the amplitude of said frequency-domain signals to determine amplitude corrected signals by multiplying the amplitude of each of said frequency-domain signals by a weight predetermined based on an amplitude-frequency response; and a process for integrating the amplitude-corrected signals to determine the subband signals.

18. The computer readable storage device for suppressing noise according to claim 17, further causing a computer to execute:

a process for correcting the phase of said frequency-domain signals to determine phase corrected signals by rotating a phase of each of said frequency-domain signals by an angle predetermined based on a phase-frequency response; and a process for transforming the result in which said amplitude corrected signals are weighted by said spectral gains and combined with said phase corrected signals into time-domain signals.

19. The computer readable storage device for suppressing noise according to claim 17, further causing a computer to execute:

a process for removing an offset of the input signal to determine an offset-free signal; and a process for transforming the offset-free signal into frequency-domain signals.

20. A noise suppressing method, comprising:

transforming an input signal into frequency-domain signals with a first frequency resolution, frequency-domain signals comprising a plurality of frequency components, the input signal including a speech or audio signal;

determining spectral gains with based on said frequency-domain signals, wherein the number of said spectral gains is less than the number of frequency components in said frequency-domain signals; and weighting said frequency-domain signals by the spectral gains to suppress noise contained in the input signal, wherein at least one of the spectral gains is employed for a plurality of said frequency components.

21. The noise suppressing method according to claim 20, further comprising:

determining subband signals with a second frequency resolution based on the frequency-domain signals, wherein the second frequency resolution is smaller than the first frequency resolution;

determining estimated noise based on said subband signals; and determining spectral gains based on said subband signals and said estimated noise.

22. A noise suppressing apparatus for suppressing noise, comprising:

a transformer for transforming an input signal into frequency-domain signals with a first frequency resolution, the input signal including a speech or audio signal;

a band integrator for integrating said frequency-domain signals to determine subband signals with a second frequency resolution that is smaller than the first frequency resolution;

a spectral gain generator for determining a single spectral gain for each subband signal based on the respective subband signal; and a multiplier for weighting said frequency-domain signals by the spectral gains;

wherein said multiplier employs at least one of said spectral gains for a plurality of said frequency-domain signals.

23. The noise suppressing apparatus according to claim 22, further comprising:

a noise estimator for determining estimated noise, each of which is common to each of said subband signals, wherein said spectral gain generator determines spectral gains based on the estimated noise, said spectral gains having the same frequency resolution as said subband signals.

24. A non-transitory computer readable storage device embodying a computer program for performing a signal process in which, to suppress noise contained in an input signal including a speech or audio signal, the input signal is transformed into frequency-domain signals with a first frequency resolution and comprising a plurality of frequency components, spectral gains are determined based on subband signals, and said frequency-domain signals are weighted by the spectral gains, said computer program which when executed by a computer causes a computer to execute:

a process for integrating said frequency-domain signals to determine subband signals with a second frequency resolution that is smaller than the first frequency resolution;

a process for determining, for each single subband signal, a single spectral gain based on the respective subband signal; and a process for employing at least one of the spectral gains to weight a plurality of said frequency-domain signals.

25. The computer readable storage device according to claim 24, wherein said computer program which when executed by a computer further causes a computer to execute:

a process for determining estimated noise each of which is common to each of said integrated frequency-domain signals; and a process for determining said spectral gains based on the estimated noise, wherein said estimated noise has a lower frequency resolution than that of said frequency-domain signals.

* * * * *